US005797079A

United States Patent [19]

Creutzmann et al.

[11] Patent Number: 5,797,079

[45] Date of Patent: Aug. 18, 1998

[54] PRINTER MEANS FOR PRINTING FRONT AND/OR BACK SIDE OF A BAND-SHAPED RECORDING MEDIUM

[75] Inventors: Edmund Creutzmann, Mark Schwaben; Walter Kopp, Kirschenstrasse; Heinz Herzog, München, all of Germany

[73] Assignee: Siemens Nixdorf Informationssysteme Aktiengesellschaft, Paderborn, Germany

[21] Appl. No.: 817,180

[22] PCT Filed: Jan. 4, 1995

[86] PCT No.: PCT/DE95/00008

§ 371 Date: Apr. 7, 1997

§ 102(e) Date: Apr. 7, 1997

[87] PCT Pub. No.: WO96/11424

PCT Pub. Date: Apr. 18, 1996

[30] Foreign Application Priority Data

Oct. 6, 1994 [DE] Germany ..... 44 35 797.4

[51] Int. Cl.[6] ..... G03G 21/00

[52] U.S. Cl. ..... 399/384; 399/401

[58] Field of Search ..... 399/384, 401; 226/197, 199; 101/223; 271/184, 185, 186, 225

[56] References Cited

U.S. PATENT DOCUMENTS 5,546,178 8/1996 Manzer et al. ..... 399/384

5,568,245 10/1996 Ferber et al. ..... 399/384

FOREIGN PATENT DOCUMENTS 0 257 789 3/1988 European Pat. Off. .

OTHER PUBLICATIONS

IBM Technical Disclosure Bulletin, vol. 22, No. 6, Nov. 1979, K. Sanders, "Two–Path Electrophotographic Print Process", pp. 2465–2466.

Xerox Disclosure Journal, vol. 9, No. 3, May/Jun. 1984, E. McIrvine, "Method for Duplex Printing on Continuous Web Paper", pp. 201–203.

*Primary Examiner*—Nestor R. Ramirez

*Attorney, Agent, or Firm*—Hill & Simpson

[57] ABSTRACT

A printer for selectively printing on one or both sides of a web-shaped recording medium includes a paper turn-over apparatus in the paper conveying channel. The turn-over apparatus is a removable unit and can be changed from a turn-over operation for two sided printing to a parallel conveyance for one sided printing of two recording mediums. A conveyor that moves the recording medium through the printer has an adjustable width to adapt to different recording medium widths. The conveyor includes a return which returns the recording medium to the turn-over apparatus after being printed on one side. The return includes a traction roller pair and a lever to swivel one of the rollers in and out. A connecting channel leads from the traction rollers and includes guide baffles. Conveyor rollers are arranged along the connecting channel at less than the spacing of the folds in the folded recording medium. The guide surfaces for the recording medium have air openings to generate an air pillow between the recording medium and the guide surface.

19 Claims, 19 Drawing Sheets

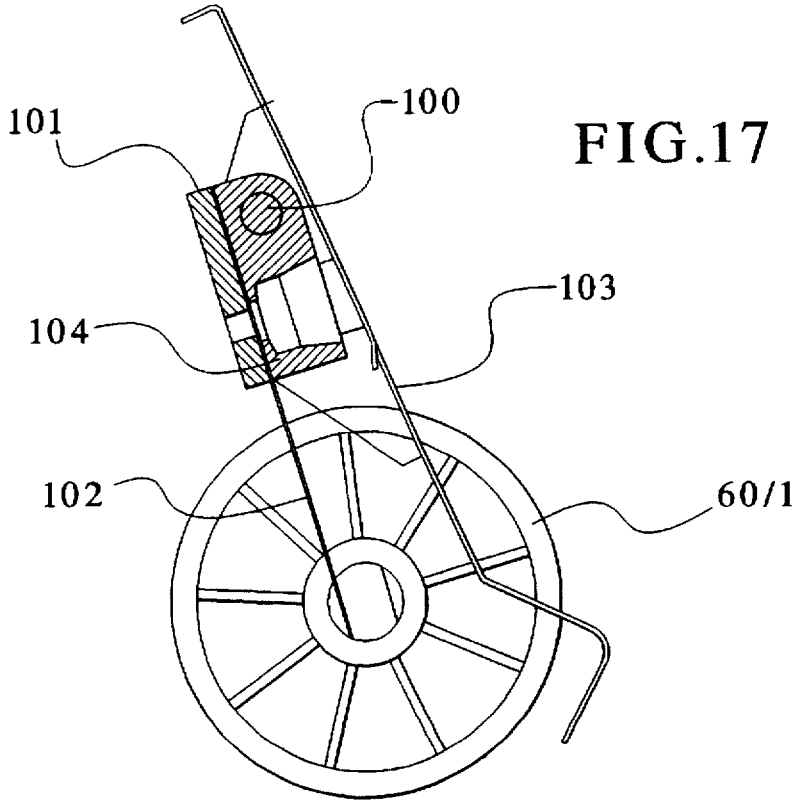
FIG.17
FIG.18
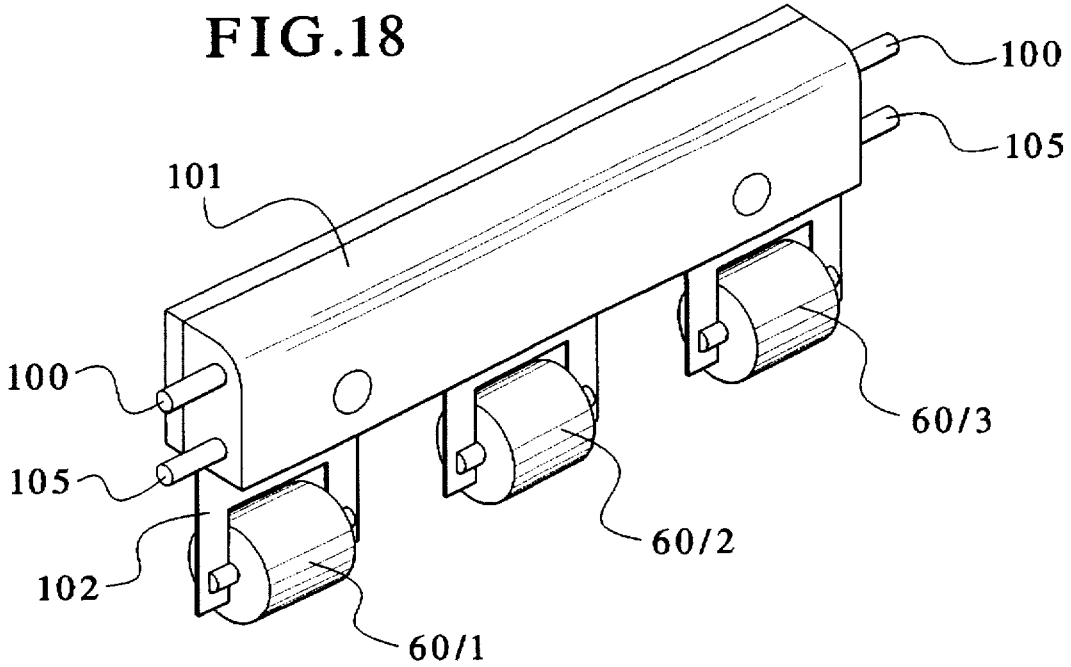

PRINTER MEANS FOR PRINTING FRONT AND/OR BACK SIDE OF A BAND-SHAPED RECORDING MEDIUM

BACKGROUND OF THE INVENTION

1. Field of the Invention

The invention is directed to a printer means for printing the front side and back side of a band-shaped recording medium having a turn-over means with appertaining delivery means arranged therein.

2. Description of the Related Art

A high economic customer benefit and a broad spectrum of flexibility are expected to a greatly increasing degree from modern electrographic printer systems. The effective utilization of printing materials as well as the flexible design of the print information play a great part therein.

Endlessly processing (fan-fold) electrographic printer systems that print a band-shaped recording medium on one side have prevailed in the marketplace everywhere that a high device availability given high printing volume and a broad spectrum of printing materials are required. These printer systems, however, have the disadvantage that it is not possible to switch between single-sided and double-sided printing. For the user, this leads both to an economically unfavorable situation as well as being contrary to the contemporary demands for efficient utilization of raw materials. Many customer-specific applications that necessarily require double-sided printing (brochures, books, etc.) can thus not be satisfied, particularly since electrographic high-performance printers are especially economical when they are operated interruption-free insofar as possible.

For generating multi-color and backside printing with electrographic printer devices working with continuous stock, European Patent Document EP-B1-01 54 695 has disclosed that two continuous stock printers be operated following one another, whereby the paper printed in the first printer is turned over and is subsequently printed on the second side in the second printer.

The outlay is substantial because of the required second printer.

IBM Technical Disclosure Bulletin, Vol. 22, No. 6, November 1979, pages 2465–2466, also discloses an electrophotographic printer means for printing band-shaped recording media with which it is possible to print the recording medium on both sides. To this end, the recording medium is taken from a supply stack, supplied to a transfer printing station, and provided with toner images on one side. After the fixing, the recording medium is turned over with the assistance of a turn-over means composed of deflection rods and is resupplied to the transfer printing station. After the back side of the recording medium is printed with toner images, another fixing step ensues in the fixing station.

This old reference basically describes duplex printing with continuous stock recording media. However, the proposal never lead to a product. Further, the described electrographic printer means is only suitable for the both-sided printing of the recording medium. A change in operating mode is not provided. The turn-over means composed of deflection rods that is employed requires a manual threading of the recording medium; further, the way in which the deflection rods are arranged requires much installation space.

The reference XEROX DISCLOSURE JOURNAL, Volume 9, No. 3, May 1984, Stanford, Conn., USA, pages 201 through 203 discloses methods for duplex printing with a band-shaped recording medium having differently constructed electrophotographic printer devices. In a first duplex printing process, a toner image is thereby first applied to a front side of the recording medium, and then the recording medium together with the toner image is turned over and, simultaneously or immediately before the turning, the toner image is fixed with a first fixing means attached in the region of the turn-over means. Subsequently, a back side toner image is applied with the assistance of the transfer printing station, this then being in fixed with the assistance of another fixing means attached at the output side relative to the printer means. In a second method for producing duplex printing, a front side toner image is first applied with the assistance of the transfer printing station. Subsequently, the recording medium is turned over and the application of the back side toner image follows. Both toner images a fixed at the same time via a fixing station arranged at the output side. In a third method for producing simplex printing on a narrow or double-width recording medium, the application of the single toner image ensues with a correspondingly width-adapted transfer printing station, whereby the toner image is then fixed via a width-adapted fixing station at the output side.

A switching between the individual operating modes, for example duplex and simplex, is not provided within a single printer device with corresponding adaptation of the paper transport. Further, a specific fixing station structure is proposed for each operating mode.

The recording medium must be supplied to the turn-over station via a return channel so that printing can be carried out in duplex mode with the inventive printer means. This is preferably equipped with a fully automatic threading means. There is thereby the problem that the paper web can, dependent on its nature, jam before it reaches the turn-over means. The involved insertion event must then be repeated.

Given a stop in printing, the paper transport must stop the paper web side-suited, and it must be in turn started side-suited given a start of printing.

Since a deceleration distance given every paper web stop and an acceleration distance given every paper web start are required, the paper web must be retracted to such an extent in front of the transfer printing station given a stop event that it can be accelerated given a restart and synchronized for the transfer printing.

The paper transport rollers of the return channel support the retraction motion of the paper transport so that this paper pull-back can be implemented given a relaxed paper web insofar as possible. An overload of the paper transport perforations or, respectively, too great a widening of the transport perforations, which leads to positioning errors in the print format after the restart, would be the result without this pull-back relief.

The traction roller forces for the print operation must be designed such that it is guaranteed that the paper web is reliably transported out of the fixing station. Further, the traction roller forces dare not be so high that they take effect through the fixing gap between pressure and fixing roller and thus disadvantageously influence the paper running in the fixing station.

In the back transport after a paper stop, the traction rollers of the back side web pull the paper load-free from the stacker unit or from an after-processing loop. However, the traction rollers of the front side web must pull the paper web back through the duplex return and the paper web turn-over means. As a result thereof, the resistance is so high that this can lead to paper tearing during the paper pull-back.

SUMMARY OF THE INVENTION

It is therefore a goal of the invention to offer a printer means for printing the front side and the back side of a band-shaped recording medium having a turn-over means with appertaining delivery means for the recording medium that enables an easy and simple change in operating mode.

The printer means should also be fashioned such that a reliable threading of the recording medium into the turn-over station is guaranteed.

A further goal of the invention is to fashion the printer means such that the printer operation can be interrupted and reassumed without damage to the recording medium.

In that the functional units of the printer means, particularly the fixing station and the transfer printing station, respectively have a usable width of at least twice the band width of the recording medium, an easy change of operating mode and an easy insertion of the recording medium into the printer means is possible in conjunction with the controllable conveyor means at the input side of the connecting channel to the turn-over means.

The means for setting the frictional force on the recording medium that is preferably allocated to the input-side conveyor means of the connecting channel according to an embodiment of the invention allows an adaptation to different recording medium materials and thus prevents damage. The range of pressing power and the reference position of the force setting means can be set as needed via the mechanically uncouplable actuating drive and without tools.

When, according to a further embodiment, the connecting channel contains controllable conveyor means arranged at the input side and output side and when a buckling of the recording medium is prevented by the dimensioning of its clearance, then a malfunction-free stopping and restarting of the printer is possible.

BRIEF DESCRIPTION OF THE DRAWINGS

Embodiments of the invention are shown in the drawings and are described in greater detail below by way of example. Shown are:

FIG. 17 is a schematic sectional view of a pressure roller unit arranged in the conveyor means;

FIG. 18 is a schematic, perspective view of the pressure roller unit;

DETAILED DESCRIPTION OF THE PREFERRED EMBODIMENTS

Figures 1, 1A:
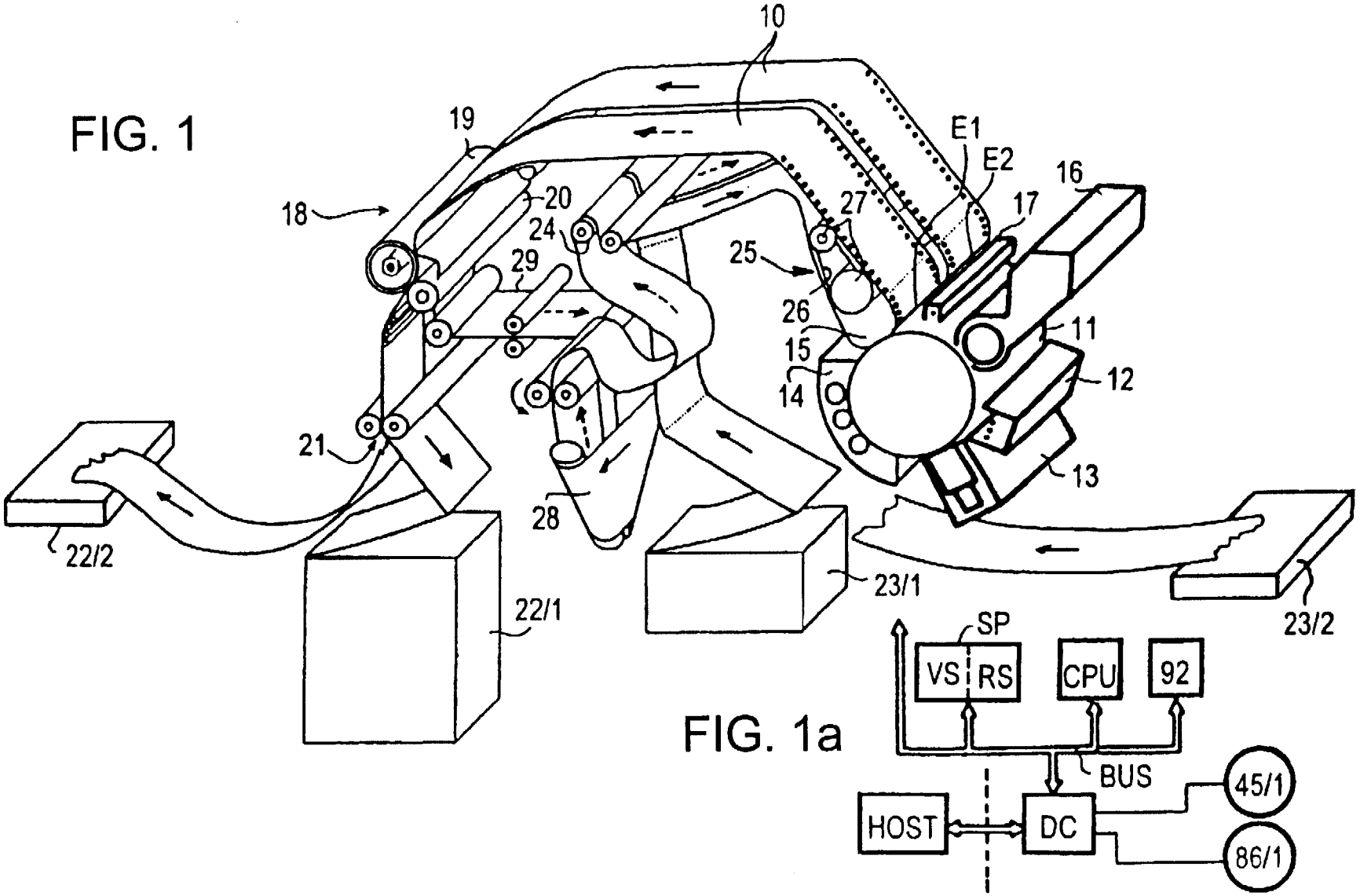
FIG. 1 is a schematic illustration of an electrographic printer means for printing band-shaped recording media in duplex operation.
FIG. 1*a* is a block diagram of a control for the printer of FIG. 1.

An electrographic printer means for printing band-shaped recording media 10 of different band widths contains an electromotively driven photoconductive drum as intermediate carrier 11. However, a band-shaped intermediate carrier, for example an OPC band, or a magneto-styli arrangement as disclosed, for example, by European Patent Document EP-B1-0 191 521 can also be employed instead of the photoconductive drum. The various units for the electrophotographic process are grouped around the intermediate carrier 11. These are essentially: a charge means 12 in the form of a charge corotron for charging the intermediate carrier 11; a character generator 13 with a light-emitting diode comb for character-dependent exposure of the intermediate carrier 11 that extends over the entire usable width of the intermediate carrier 11; a developer station 14 for inking the character-dependent charge image on the intermediate carrier 11 with the assistance of a one-component or two-component developer mix; a transfer printing station 15 that extends over the width of the intermediate carrier 11 and with which the toner images are transferred onto the recording medium 10. A cleaning station 16 with cleaning brushes and appertaining extraction means integrated therein as well as a discharge means 17 is provided for removing the residual toner after the development and the transfer printing. The intermediate carrier 11 is electromotively driven and moves in arrow direction during printing operation.

Further, the printer means contains a fixing station 18 that follows the transfer printing station 15 in conveying direction of the recording medium, this fixing station 18 being fashioned as thermal pressure fixing station with a heated fixing drum 19 with appertaining pressure roller 20, and also contains a delivery means 21 following the fixing station with guide rollers for delivering the recording medium 10 to an internal stacker means 22/1 or to an external stacker arranged outside the printer means or some other after-processing means 22/2. Other fixing stations, for example with a heated or unheated admission saddle or a cold fixing station are also possible instead of the illustrated fixing station. The band-shaped recording medium 10 is fabricated, for example, a pre-folded continuous stock with margin perforations and, proceeding from an internal 23/1 or external 23/2 supply region, is supplied via delivery rollers 24 to a paper separator means of the transfer printing station 15 that can be swivelled out. However, it is also possible to supply a recording medium without margin perforations via a roller delivery.

The transport of the recording medium thereby preferably ensues via a conveyor means 25 allocated to the transfer printing station 15 in the form of conveyor belts 26 provided with pins that, conducted over drive shafts 27, engage into the margin perforations of the recording medium 10. When a recording medium free of transport holes is employed, an appropriately adapted conveyor means is to be provided that transports the recording medium by, for example, friction under the control of a control arrangement that senses synchronization marks. Further, a turn-over means 28 is arranged in the housing region of the printer means, namely in an acceptance region for the internal supply stack 23/1; the structure and function of this means 28 shall be explained later, the recording medium already printed on the front side being turned over thereover for printing the backside thereof and being resupplied to the transfer printing station 15.

The turn-over means 28 is in communication with the fixing station 18 via a return channel 29.

The printer means is controlled via a printer controller, which is schematically shown here in FIG. 1*a*, comprising a central unit CPU, a page memory SP that is divided page-dependent into memory areas, as well as a data control unit DC. All units of the controller are connected via a BUS system to one another and to the units of the printer means.

The electrographic printer means is suitable for printing recording media with different band widths. To this end, the intermediate carrier 11 (photoconductive drum) exhibits a usable width that corresponds to the biggest possible recording medium width (for example, a broad recording medium having a width corresponding to the format DIN A3 crosswise). This width corresponds to twice the DIN A4 band width. It is thus possible to arrange two narrower recording medium webs with format DIN A4 longitudinally side-by-side in the region of the transfer printing station 15. The fixing station 18 and the other electrophotographic units such as developer station 14, character generator 13, cleaning station 16 are designed according to this usable width.

An adaptation of the width of the character generator 13 to different recording medium widths requires no mechanical alteration at the character generator when, as in this case, a LED character generator having a plurality of LEDs arranged in rows is employed. An adaptation to the recording medium width employed ensues electronically by control.

For adaptation of the conveyor means 25 to different recording medium widths, the conveyor means can be designed adjustable in width. This can be achieved, for example, in that the drive wheels that carry the conveyor belts (knob belts) engaging into the margin perforations of the recording medium are displaceably seated on polygonal shafts.

When two narrow recording medium webs are arranged side-by-side in the region of the transfer printing station 15 and transported, then it normally suffices to provide a conveyor means only for the respectively outwardly disposed margin perforations of the recording medium webs. Given an appropriate design, it is therefore possible to employ the same conveyor belts for the broad recording medium and the narrower recording medium or media without having to adjust these conveyor belts. If it is nonetheless necessary to guide the recording media at both sides, then separate transport elements that engage into the margin perforations of the recording media can be centrally arranged for operation with two narrow recording media arranged next to one another. So that these transport element do not interfere given operation with only one broad recording medium, they can be arranged pluggable and unpluggable or pivotable or, on the other hand, it is possible to provide the drive wheels 27 of the conveyor means 25 with pins or, respectively, nubs that can be extended and retracted.

The turn-over means 28 coupled to the fixing station 18 via the return channel 29 for narrow recording media has two jobs: first, it serves for the lateral adjustment of the recording medium web so that a parallel guidance is possible in the region of the transfer printing station 15 and, second, it serves for front side / back side flipping of the recording medium. It can be designed switchable dependent on operating mode.

The inventive printer means enables the greatest variety of operating modes without modifying the hardware structure:

For both-sided printing of a narrow recording medium 10 in duplex operation as shown in FIG. 1, the narrow recording medium 10, for example DIN A4 wide, is supplied to the transfer printing station 15 via the delivery rollers 24 proceeding from the supply region 23 and is printed with a front side toner image on its upper side in a transfer printing sub-region E1. The front side of the recording medium 10 is thereby identified by solid-line transport arrows, the back side by broken-line transport arrows. The recording medium with the loose, electrostatically adhering front side toner image is then supplied to the fixing station 18, and the front side toner image is fixed therein. Continued transport of the recording medium then ensues via the return channel 29 to the turn-over means 28 whose deflection contour is positioned in a turn-over attitude. The recording medium is flipped by 180° with respect to its front and back side in the turn-over means 28 and is resupplied to the transfer printing means 15 via the deliver rollers 24 such that its back side can be provided with a back side toner image in the transfer printing sub-region E2. Subsequently, the recording medium is resupplied to the fixing station 18 and the back side toner image is fixed, and, subsequently, the recording medium printed on both sides is deposited in the stacker means 22/1 or output for paper after-processing into a cutter means 22/2 or the like.

Since the front side and back side toner images are generated at different points in time and are transfer printed onto the single, narrow recording medium, a corresponding data editing via the printer controller is needed. To this end, the page memory SP contains memory areas VS for storing the front side image data and memory areas RS for storing the back side image data. The data editing thereby ensues via the data control means DC, whereby the data are supplied to the data control means DC from a data source (HOST), for example an external data storage, via an interface. The data of the individual pages to be printed are thereby deposited in the page memory SP, namely in the appropriate memory areas separated according to front side VS and back side RS. The calling of the data then ensues under time control, so that the desired front side/back side allocation of the toner images on the recording medium is achieved.

Figure 2:
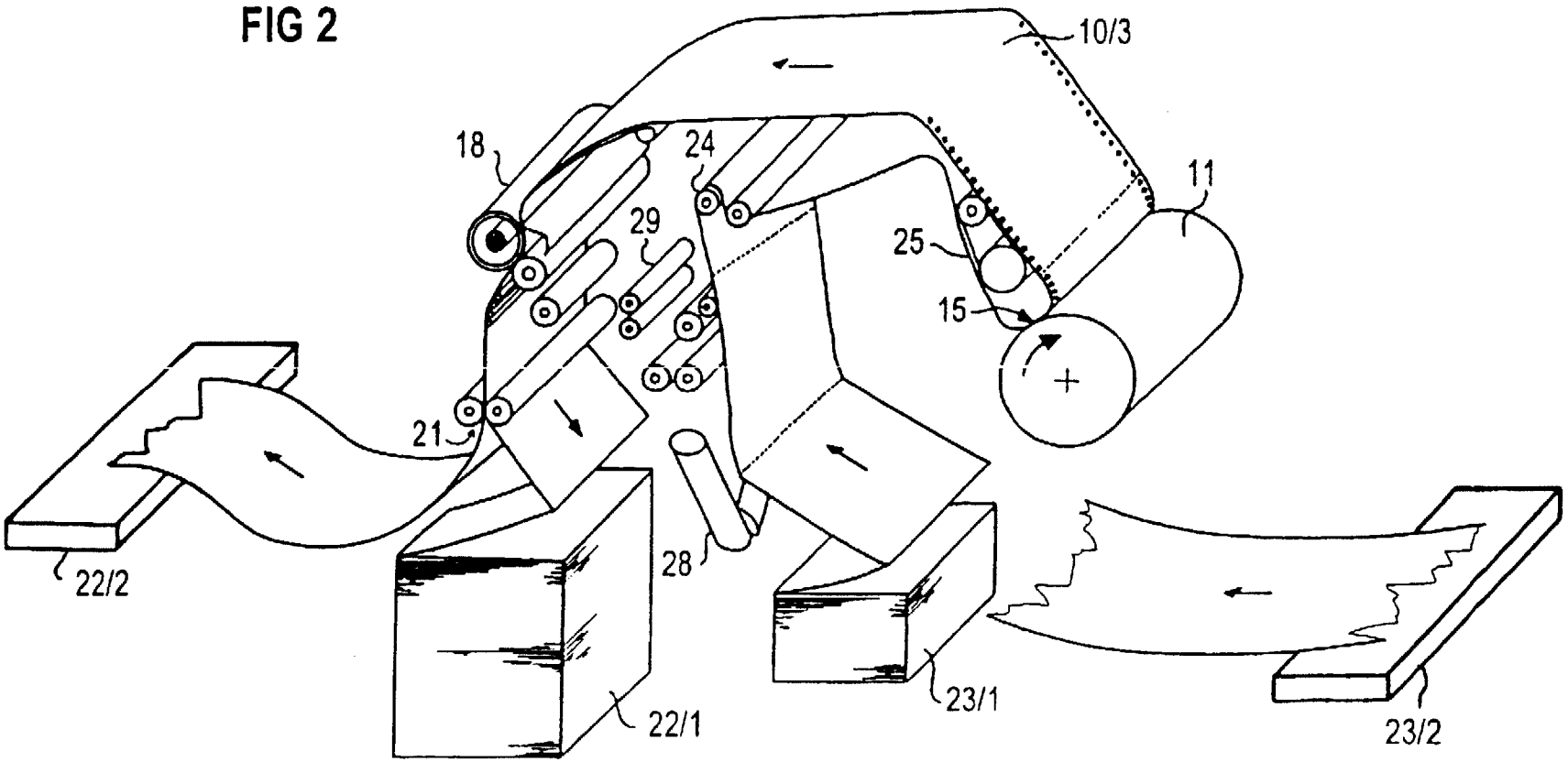
FIG. 2 is a schematic illustration of the same electrographic printer means in simplex operation for printing a single, broad recording medium.

For single-sided printing of a single, broad recording medium 10/3, for example in the format A3 broadside or narrower, the recording medium 10 in the illustration of FIG. 2 is conducted in a conventional way from the supply regions (supply stack) 23/1 or 23/2 via the delivery rollers 24 (paper separator) to the transfer printing station 15, is provided with toner images in the latter and fixed in the fixing station 18 and, subsequently, is deposited in the internal or external stacker means 22/1, 22/2. The transport thereby ensues via the conveyor means 25 that engages into the margin perforations of the recording medium, whereby the width of the conveyor means 25 is set according to the width of the recording medium.

Such a broad recording medium enables, for example, printing with toner images arranged DIN A3 broadside or, on the other hand, with two DIN A4 toner images arranged next to one another.

Figure 3:
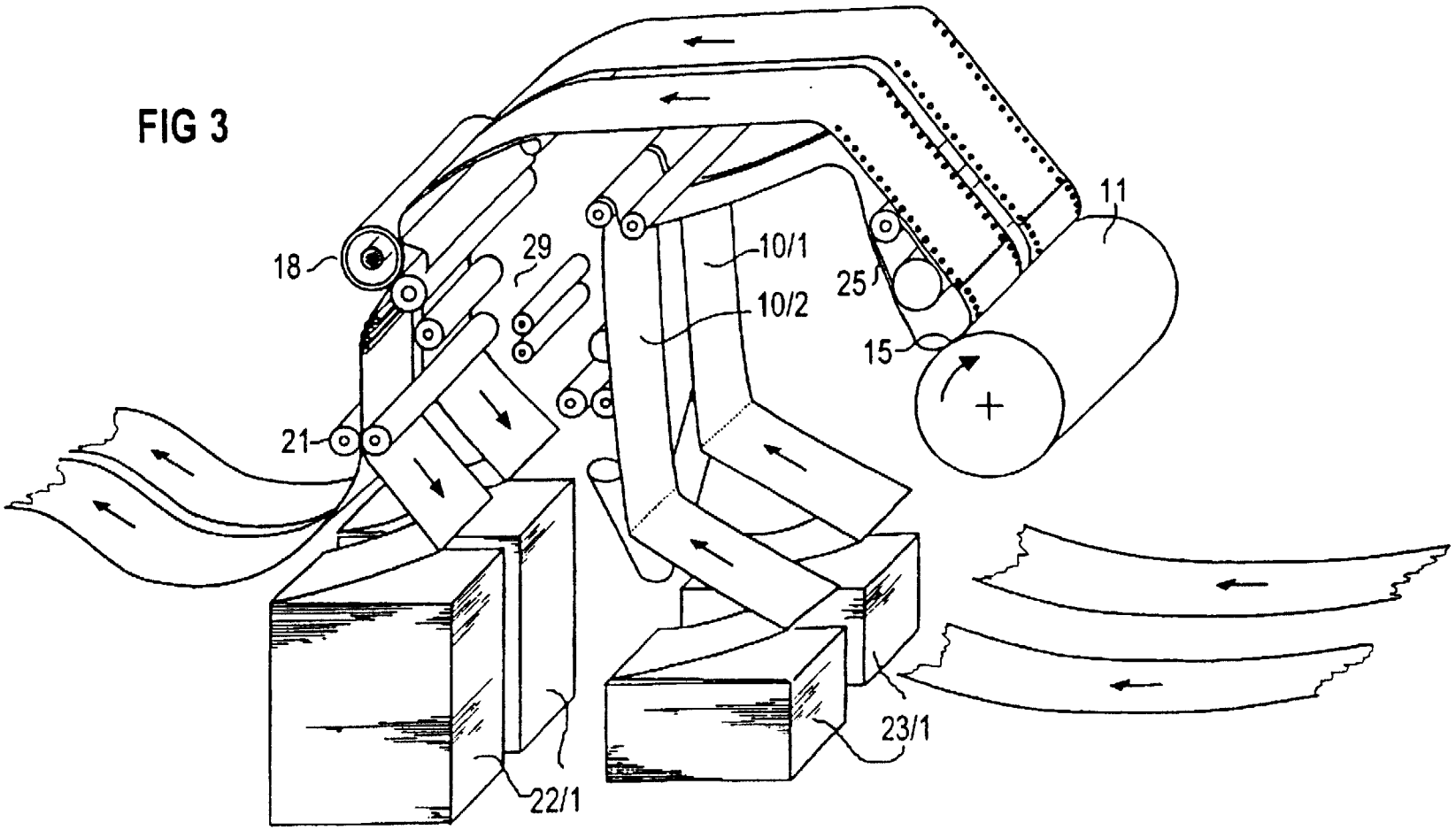
FIG. 3 is a schematic illustration of the same electrographic printer means in simplex operation for parallel printing of two narrow recording media.

For single-sided or, respectively, front-side printing of two individual, narrow recording media 10/1, 10/2 arranged next to one another, for example having a width of DIN A4, the two recording media in the illustration of FIG. 3 are conducted parallel through the printer means with the transfer printing station 15 and the fixing station 18. The transport of the recording media 10/1 and 10/2 ensues via the correspondingly set conveyor means 25. In the illustrated exemplary embodiment, the recording media 10/1 and 10/2 are transported at both sides via their margin perforations. To this end, as already set forth, the middle conveyor elements are brought into engagement with the inner margin perforations of the recording media 10/1 and 10/2 by extending appropriate pins. It is also possible to fashion these inner conveyor elements as elements that are put in place as needed. It is also fundamentally possible to employ only the outer conveyor elements for the transport of the recording media 10/1 and 10/2 in the region of the transfer printing station 15 and to thus convey the recording medium webs at one side.

Turn-Over Means

The turn-over means 28 (FIG. 4) essentially contains four deflection elements arranged like the letter W via which the narrow recording medium 10 is conducted proceeding from a paper admission channel 30 coupled to the return channel 29 (FIG. 1) up to a paper discharge channel 31 that in turn supplies the recording medium 10 to the delivery rollers 24 (FIG. 2). Paper admission channel 30 and paper discharge channel 31 are thereby arranged next to one another in one plane.

The recording medium 10 supplied to the paper admission channel 30 vie the return channel 29 is first conducted over a first oblique deflection means 32 that laterally deflects the recording medium. This means 32 is composed of a hollow deflection rod 33 or drum arranged at about 45° to the paper running direction. The first oblique deflection means 32 is followed in paper conveying direction by a first reversing means 34 having a deflection element 35 in the form of a hollow profile for returning the recording medium 10 behind the paper channels into the region of a second reversing means 36 that is arranged roughly parallel to the first reversing means 34 and reverses the recording medium 10 again. This means 36 likewise comprises a deflection element 35 in the form of a hollow profile. A second oblique deflection means 37 that deflects the recording medium 10 into the paper discharge channel 31 and has a hollow deflection rod 33 arranged at about 45° relative to the paper running direction of a drum follows the second reversing means 36.

Figure 4:
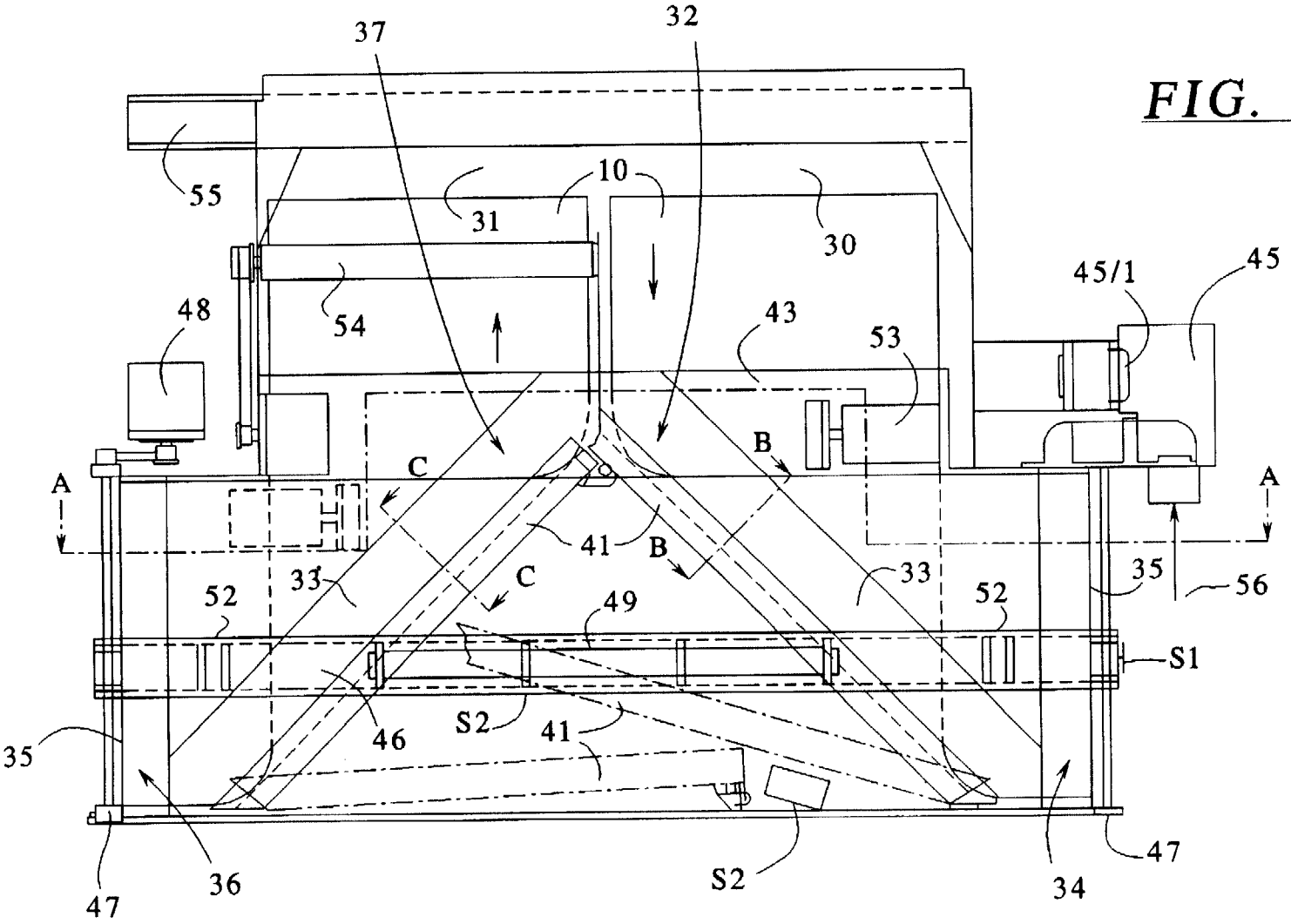
FIG. 4 is a schematic illustration of a turn-over means arranged in the electrographic printer means.
Figure 5:
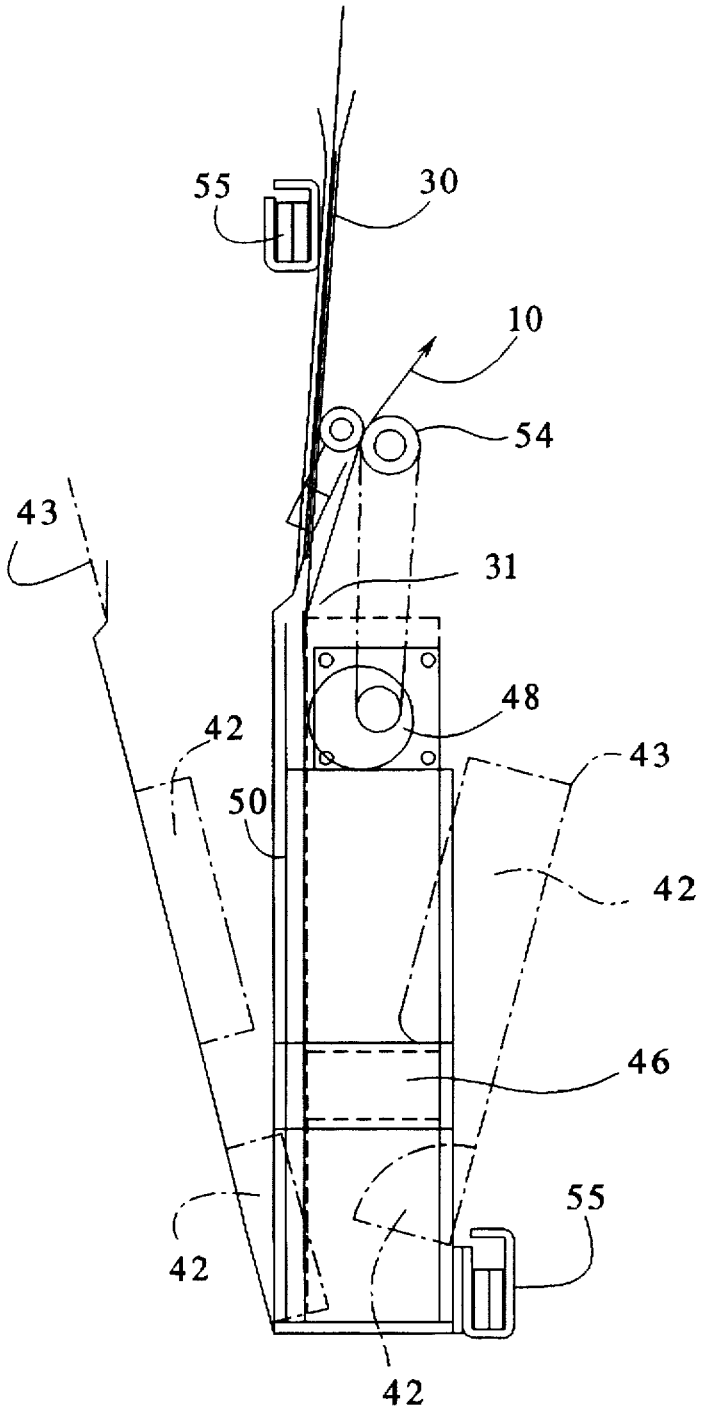
FIG. 5 is a schematic illustration of a side view of the turn-over means arranged in the electrographic printer means.
Figure 6:
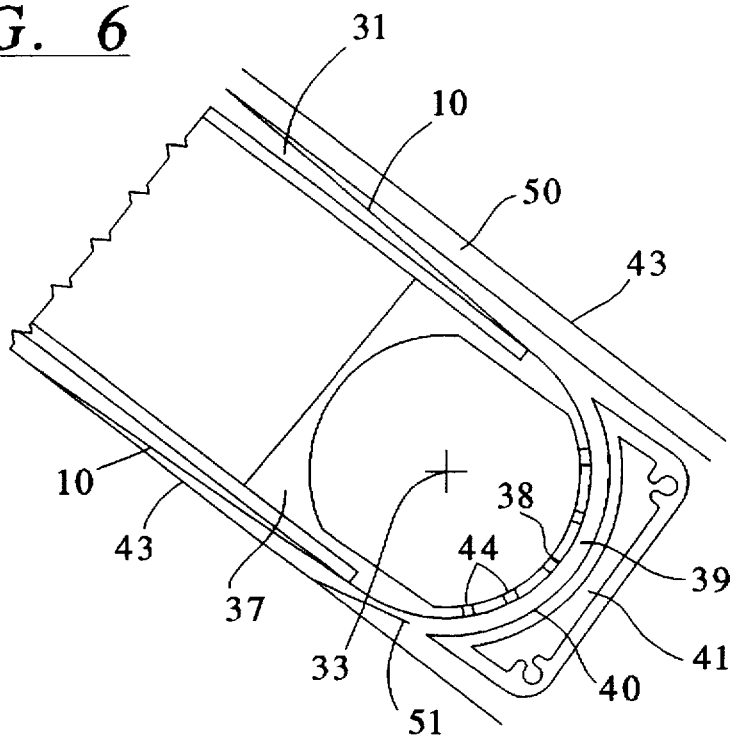
FIG. 6 is a schematic sectional view of the paper guide in the turn-over means along the section line C—C of FIG. 4.
Figure 7:
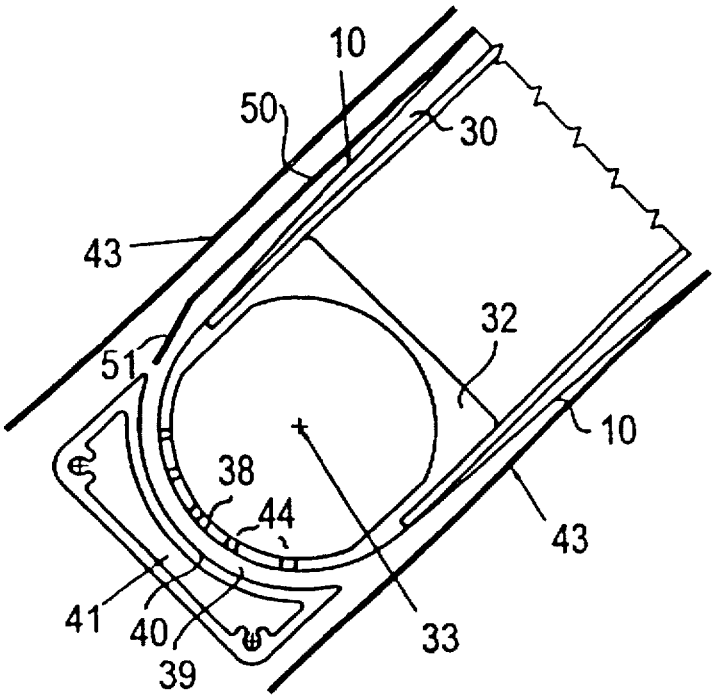
FIG. 7 is a schematic sectional view of the paper guide in the turn-over means along the section line B—B of FIG. 4.

Deflection rods 33 and deflection elements 35 comprise wear-resistant, polished surfaces as deflection surfaces 38 (FIGS. 6, 7) that serve as glide surfaces for the recording medium 10 and that are embraced by guide surfaces 40 at a distance forming a deflection channel 39. The guide surfaces 40 allocated to the deflection rods 33 of the oblique deflection devices 32 and 37 are part of flaps 41 of hollow profiles that are arranged to be swivelled out. They are shown in FIG. 4 in operating position (solid line) and in disengaged position (broken lines). The guide surfaces 40 of the deflection elements 35 are composed of spring steel sheets 42 that are arranged on front-side and back-side housing flaps 43 of the turn-over means that can be swivelled out. The housing flaps 43 are shown in the swivelled-out position with broken lines in FIG. 5.

In order to reduce the friction between glide surfaces and recording medium in the region of the deflection locations, the deflection surfaces 38 comprise air exit openings 44 (FIGS. 6, 7) via which an air pillow can be generated between recording medium and deflection surfaces, particularly during threading. The hollow spaces of deflection rods 33 and deflection elements 35 are in communication with one another and serve as air supply channels. A connection assembly 45 arranged in the device in the acceptance region for the turn-over means can be coupled to the deflection element 35 of the right-hand side for controlled delivery of blast air via a blower 56. It also contains a plug 45/1 for the electrical connection. This plug can contain a switch via which the correct connection of the turn-over means and, thus, the presence thereof can be sensed and reported to the device controller DC in the form of electrical signals.

The turn-over means also contains a threading means for the recording medium with a motor-driven gripper element guided around the reversing means 34, 36, this gripper element comprising gripper means for the start of the recording medium, whereby the start of the recording medium is grasped in the region of the first oblique deflection means 32 for being threaded into the turn-over means and being conveyed via the reversing means 34, 36 and the second oblique deflection means 37 into the region of the paper discharge channel 31.

The gripper element in the illustrated exemplary embodiment is composed of a margin-perforated conveyor belt 46 that is conducted over guide shafts 47 around the reversing devices 34, 36. It is driven via a motor 48. A friction coat 49 (friction element) of expanded material or silicone is arranged on the inside of the conveyor belt 46. Its length is dimensioned such that, given the operating condition of the turn-over means shown in FIG. 4 wherein the friction element 49 is located between the oblique deflection devices 32, 37, the friction element 49 is disengaged from the recording medium 10.

A recording medium circulation channel 50 with allocated shunts 51 for inward and outward transfer of the recording medium 10 in the region of the oblique deflection devices 32, 37 proceeds around the reversing devices 34, 36. Together with the deflection channels 39, what is fundamentally a through guide channel for the recording medium 10 thus derives around the deflection element 33, 35 from the paper admission channel 30 to the paper discharge channel 31. The conveyor belt 46 dips into the channel sections of the recording medium circulating channel that lie between the reversing devices 34, 36 and is guided there. The channel walls facing toward the friction element 49 comprise roller elements 52 (FIG. 4) in the region of the conveyor belt 46 for reducing the friction between recording medium 10 and wall surface. The recording medium 10 is clamped between the roller elements 52 and the friction element and is thus reliably conveyed by the friction element 49.

Figure 8:
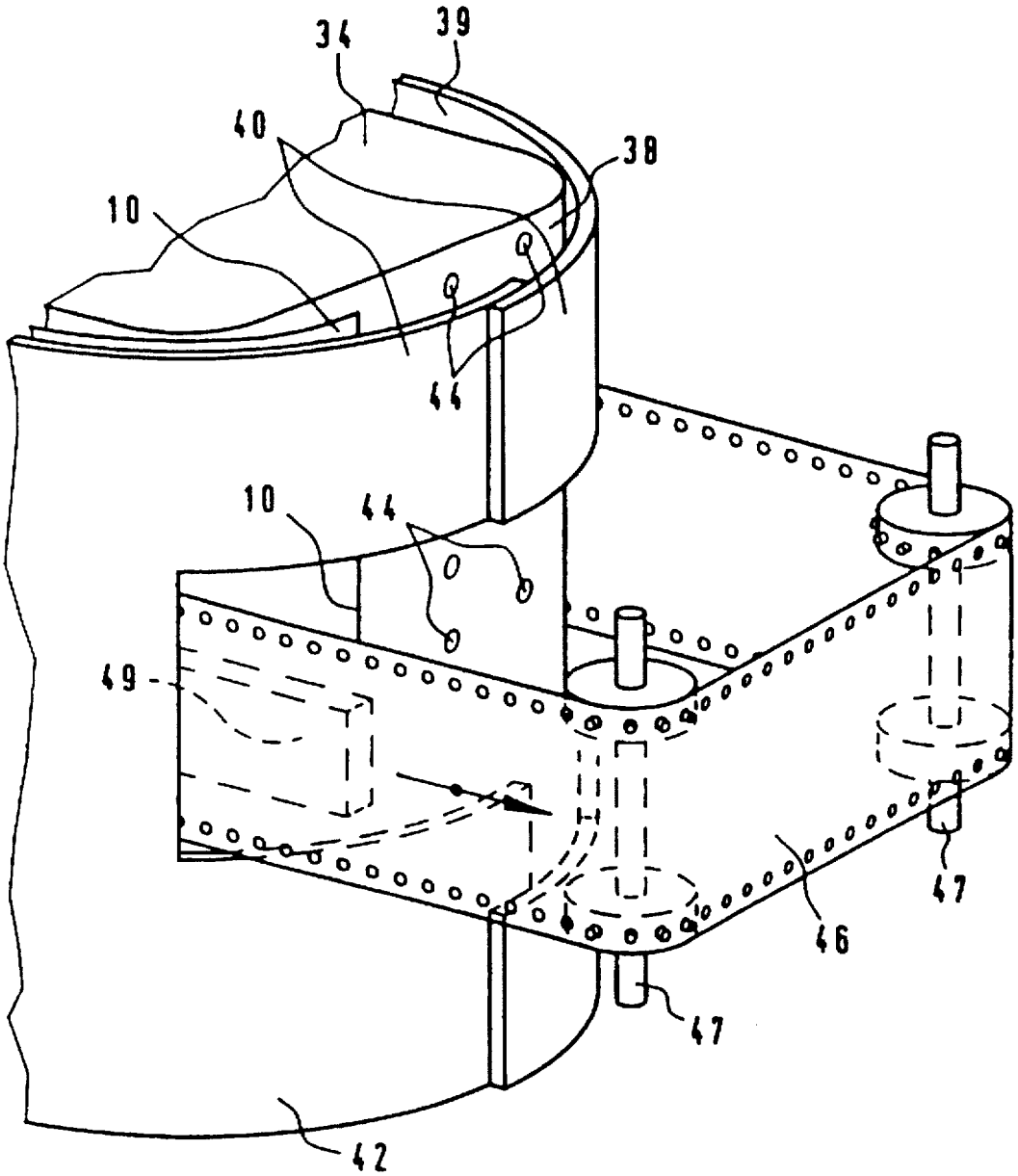
FIG. 8 is a schematic illustration of the guide in the region of the lateral reversing devices.

In the region of the reversing devices 34, 36, the conveyor belt 46 is conducted over a conveying path (FIG. 8) that proceeds outside the deflection channel 39 as part of the recording medium circulating channel 50 and that is longer than the conveying path of the start of the recording medium through the deflection channel 39. The position of the recording medium 10 relative to the friction element 49 thus changes in leading fashion when running around the reversing devices 34, 36. At the end of the threading procedure, it is thus possible to push the start of the recording medium over the back end of the friction element 49 far into the paper discharge channel 31, where it is grasped by paper transport elements 53. These paper transport elements 53 can be composed of swivellable friction wheels or beater elements or tractors with transport lamellae. They are arranged in the region of the oblique deflection devices 32, 37 in the paper admission channel 30 and in the paper discharge channel 31, namely such that they engage at the side of the recording medium 10 that is free of toner images. An additional motor-driven recording medium conveyor means in the form of paper transport rollers 54 is arranged farther downstream toward the second oblique deflection means 37, this serving the purpose of supplying the recording medium 10 to the transfer printing station over the rollers 24.

The turn-over means is controlled via a microprocessor-controlled threading control arrangement that can be part of the device controller DC. It contains a central control with a microprocessor. This has its input side in communication with an optical sensor S2 that is arranged under the first oblique deflection means 32 and that senses the start of the recording medium in the region of the first oblique deflection means 32 as well as in communication with a sensor S1 arranged in the region of the first reversing means 34 that can be fashioned as a Hall sensor and that senses the position of the friction element 49 (friction coat) via a magnet element. The threading control arrangement has its output side coupled to the blower 56 for generating the blast air, to the drives for the paper transport elements 53 and the paper transport rollers 54 and to the conveyor belt drive 48. For threading, the threading control arrangement grasps the start of the recording medium over the sensor S2 in the region of the first oblique deflection means 32, activates the conveyor belt drive 48 dependent thereon and, dependent on the position signal of the sensor S1 after threading the start of the recording medium through into the paper discharge channel 31, positions the friction element 49 in an idle position in which it is disengaged from the recording medium 10.

Figure 9:
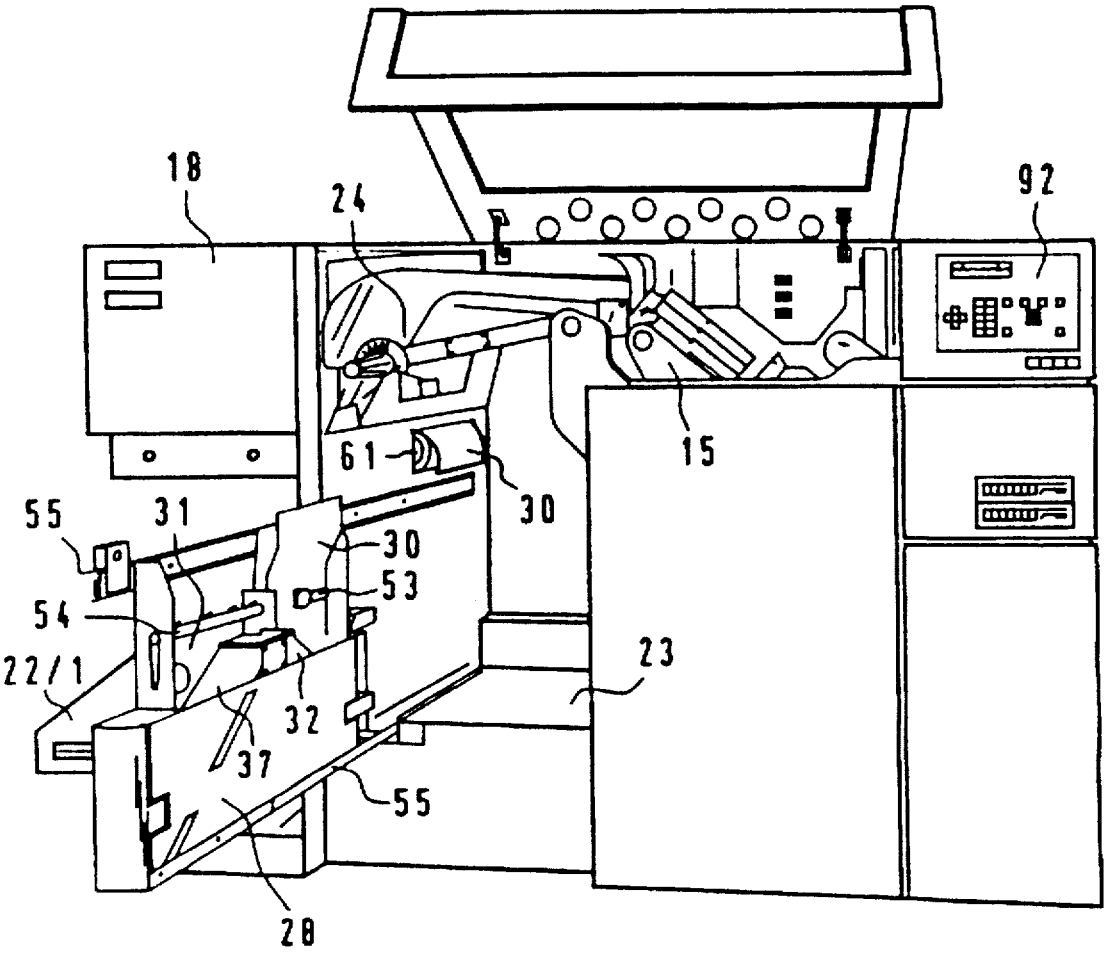
FIG. 9 is a schematic illustration of the turn-over means in service position.
Figure 10:
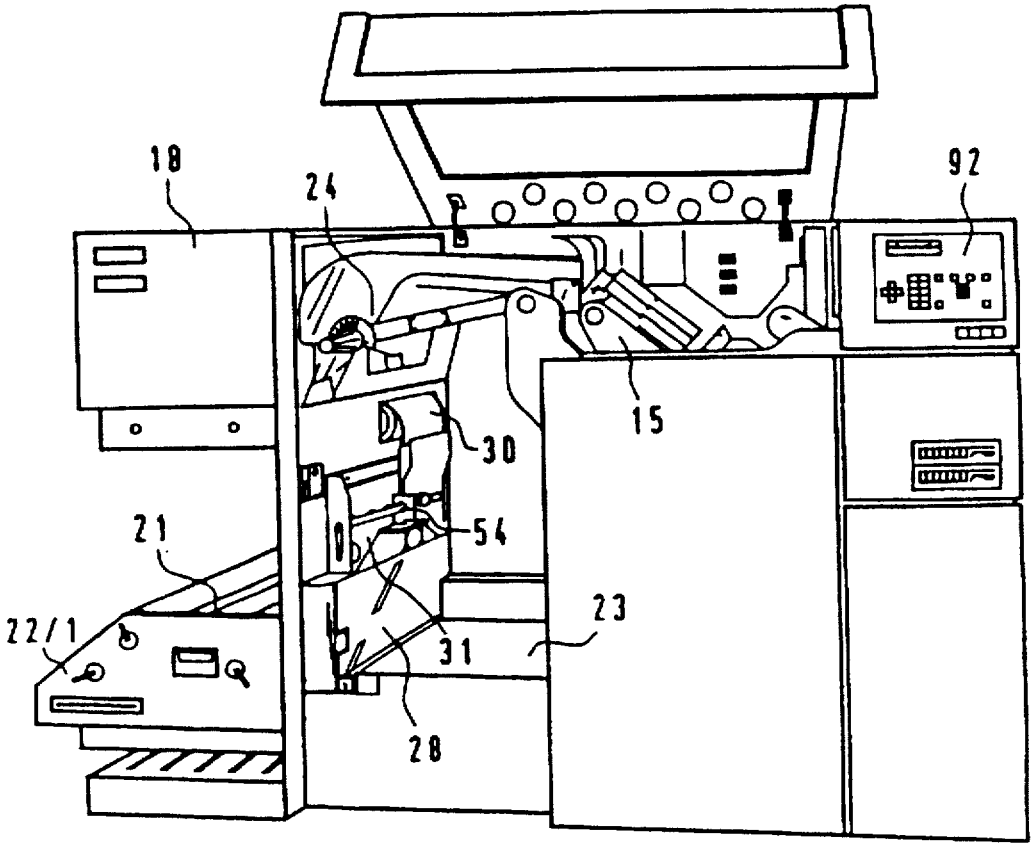
FIG. 10 is a schematic illustration of the turn-over mean in operating attitude.
Figure 11:
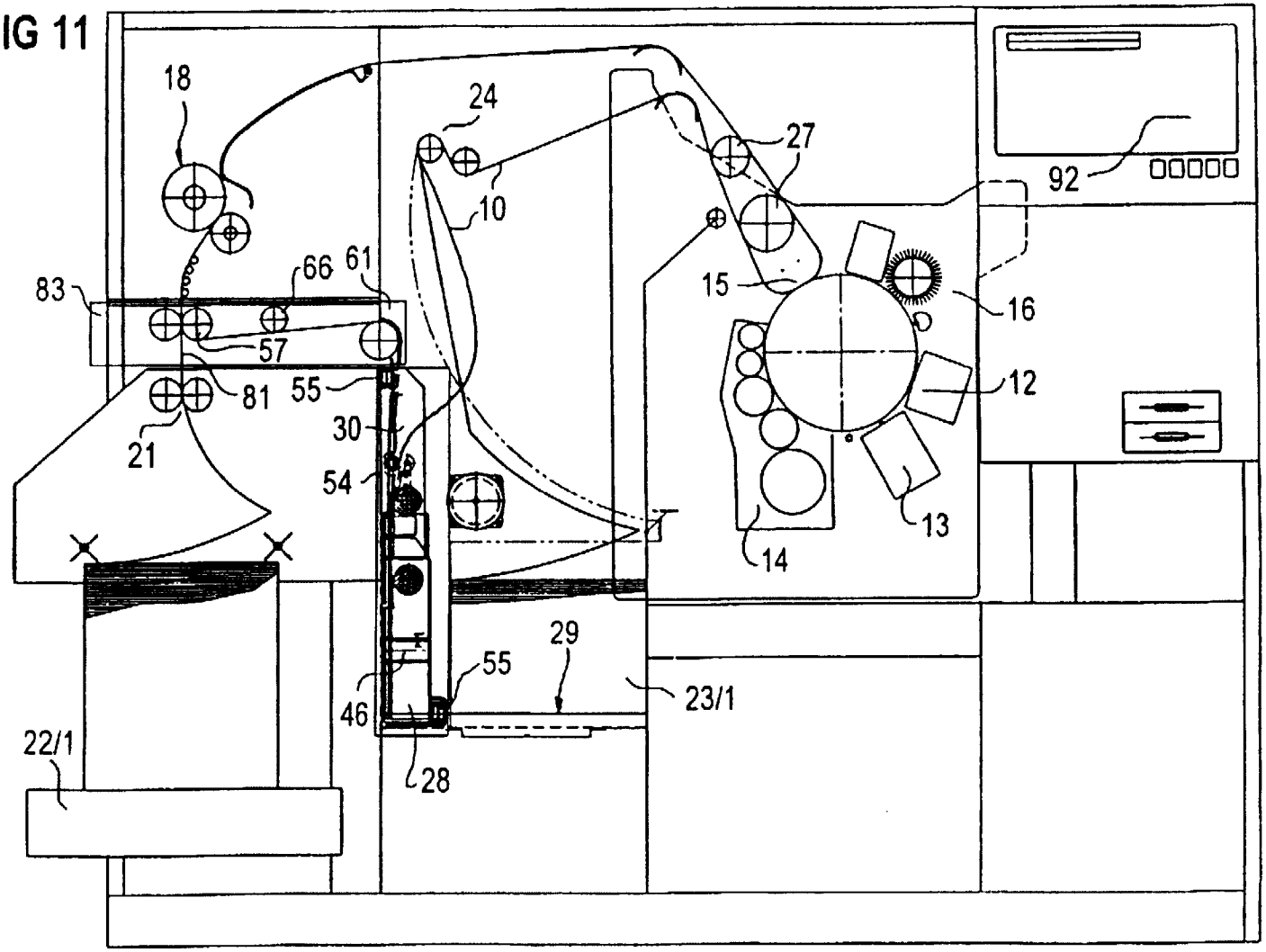
FIG. 11 is a schematic sectional view of the printer means.

The turn-over means is fashioned as an independent, torsionally stiff structural unit in the form of a module and is removably seated on telescoping rails 55 (FIGS. 9, 10) in the device in the acceptance region 23 for the internal supply stack 23/1. All deflection elements are thus freely accessible given malfunctions in paper running and in case of service.

Function of the Turn-Over Means

For automatically threading the recording medium through the turn-over means, the blower 56 for generating blast air, the drives for the paper transport elements 53 and the paper transport rollers 54 are activated via the threading control arrangement. The friction element 49 is located in the idle position shown in FIG. 4 between the oblique deflection elements 32, 37. The start of the band entering via the paper admission channel 30 is deflected in the deflection channel 39 at the first oblique deflection means 32 and recognized via the sensor S2. The conveyor belt 46 is started as a result thereof. Via the friction element 49, it seizes the band start and conveys it around the first reversing means 34. The start of the recording medium thereby somewhat leads the friction element 49. Subsequently, the start of the recording medium runs around the second reversing means 36 and thereby again somewhat leads the friction element 49. With the back end of the friction element 49, the start of the recording medium is then pushed over the shunt 51 through the second oblique deflection means 37 up into the region of the paper transport element 53, is seized by the latter and transported up into the region of the paper transport rollers 54 (FIG. 4) and is then transported from there to the transfer printing station. The threading procedure has thus been ended, and the friction coat is again in the idle position, disengaged from the recording medium (FIG. 4).

Return Means

Figure 12:
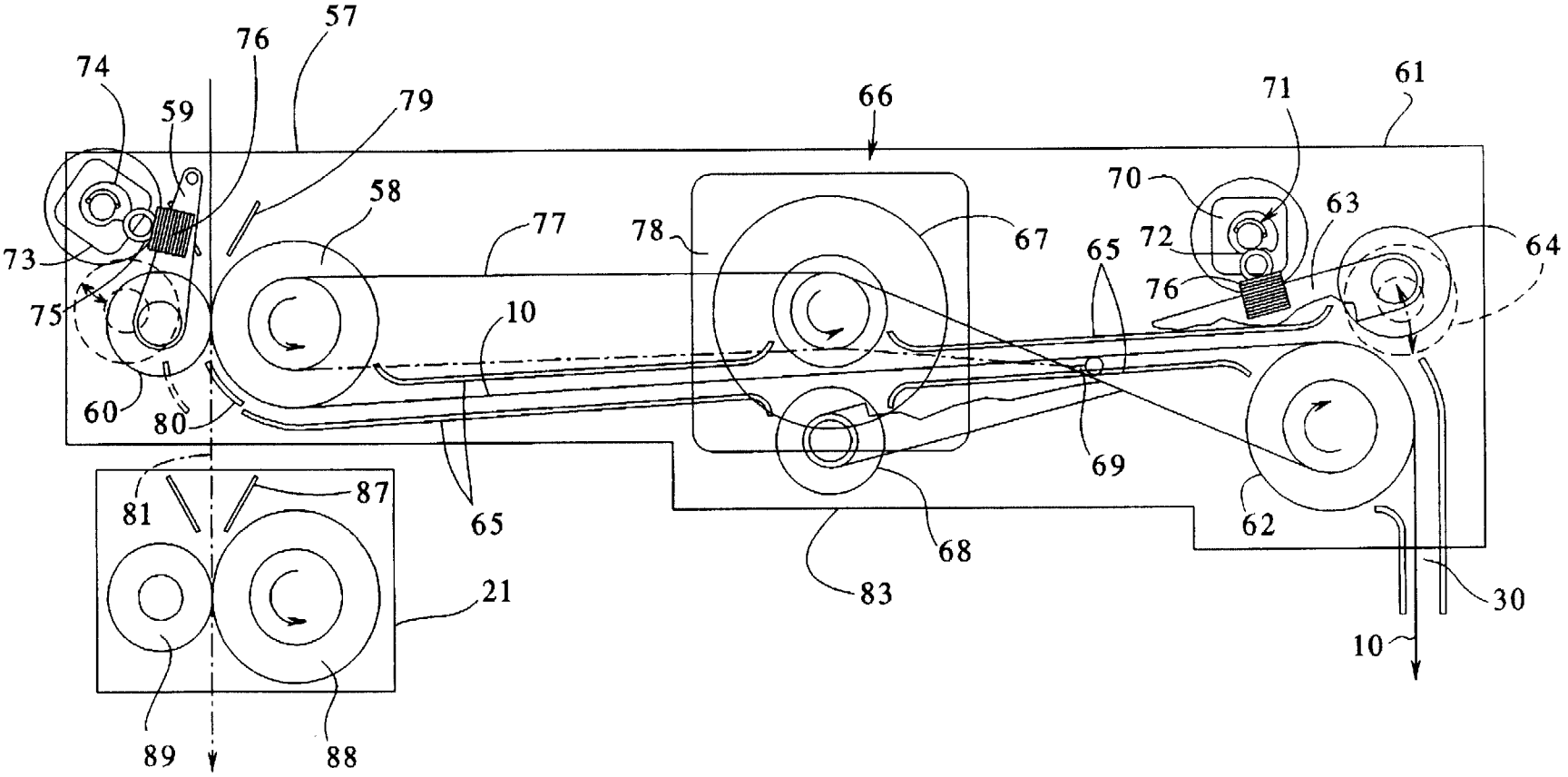
FIG. 12 is a schematic illustration of a return means to the turn-over means.

A return means (FIG. 12) is arranged in the return channel 29, this serving the purpose of returning the recording medium from the fixing station 18 to the turn-over means after the front side is printed. The return means contains a controllable conveyor means of the input side that comprises a motor-driven traction roller pair 57 with a motor-driven transport roller 58 and a pressure roller 60 that can be swivelled in and out via a lever 59. Further, a controllable conveyor means of the output side with a traction roller pair 61 that comprises a motor-driven transport roller 62 and a pressure roller 64 seated on a pivoted lever 63 that can be swivelled in and out. A connecting channel composed of upper and lower baffles that accepts the recording medium is arranged between the traction roller pair 57 of the input side and the traction roller pair 61 of the output side; the channel width of this connecting channel 65 is dimensioned such that a buckling of the recording medium in the channel is largely prevented. To this end, it exhibits a clearance of no more than 15 mm. What is thereby achieved is that the recording medium does not buckle while the start of the recording medium is being pushed through the connecting channel 65. Since the distance between the traction roller pair 57 of the input side and the traction roller pair 61 of the output side can be so great that the recording medium buckles despite the narrow connecting channel given extremely lightweight papers with, for example, a paper weight of 60 grams per square meter, a transport aid in the form of a further conveyor means is arranged between the traction roller pair 57 of the input side and the traction roller pair 61 of the output side, roughly centrally relative to the connecting channel. It is composed of a traction roller pair 66 that comprises a motor-driven transport roller 67 and a pressure roller 68 that can be swivelled against and away from the transport roller 67. Compared to the pressure roller 64, the pressure roller 68 is seated on the opposite side-of the pivoted lever 63. The pivoted lever 63 can be swivelled around a rotational axis 69, namely with the assistance of an actuator 70 that attacks at the lever 63 via cam 71 at a shoulder 72 with compression spring element 76 arranged therein. The pivoted lever 59 of the pressure roller 60 of the traction roller pair 57 of the input side is also coupled to an actuator 73 that acts on the lever 59 via a cam at a shoulder 75 with appertaining compression spring 76.

The transport roller 58, 67 and 62 composed, for example, of rubber or silicone are coupled to a central drive motor 78 via belts 77. In order to be able to reliably supply the start of the recording medium to the traction roller pair 57 of the input side, the traction roller pair 57 comprises a centering means in the form of a centering funnel 79. However, guide plates or the like can also be employed.

The recording media 10, 10/1, 10/2, 10/3 can also be composed of prefolded continuous stock, whereby the form fold spacings exhibit the greatest variety of lengths. These folds aggravate the risk of buckling during the pushing event inside the connecting channel 65 since the paper web exhibits hardly any buckling stability in the folded region. The spacing between two traction roller pairs, for example the traction roller pairs 57 and 66 or, respectively, 66 and 61, should therefore not fall below the minimum fold spacing length of the prefolded recording medium 10 employed. Recording media with a minimum fold spacing of, for example, 6 inches are known in continuous stock printers.

A shunt of the output side in the form of a deflection plate 80 pivotably coupled to the lever 59 is also allocated to the traction roller pair 57 of the input side. In the swivelled-out condition of the pressure roller 60 (shown with broken lines), a through channel for the recording medium opens between pressure roller 60 and transport roller 58 that discharges in an output channel 81 to the delivery means 21 for the internal stacker means 22/1.

The pressing power of the pressure rollers 60, 64 and 68 of the traction roller pairs is variable dependent on the position of the cams 71 and 74. The frictional force on the recording medium 10 situated between transport roller and pressure roller thus varies correspondingly.

Figure 13:
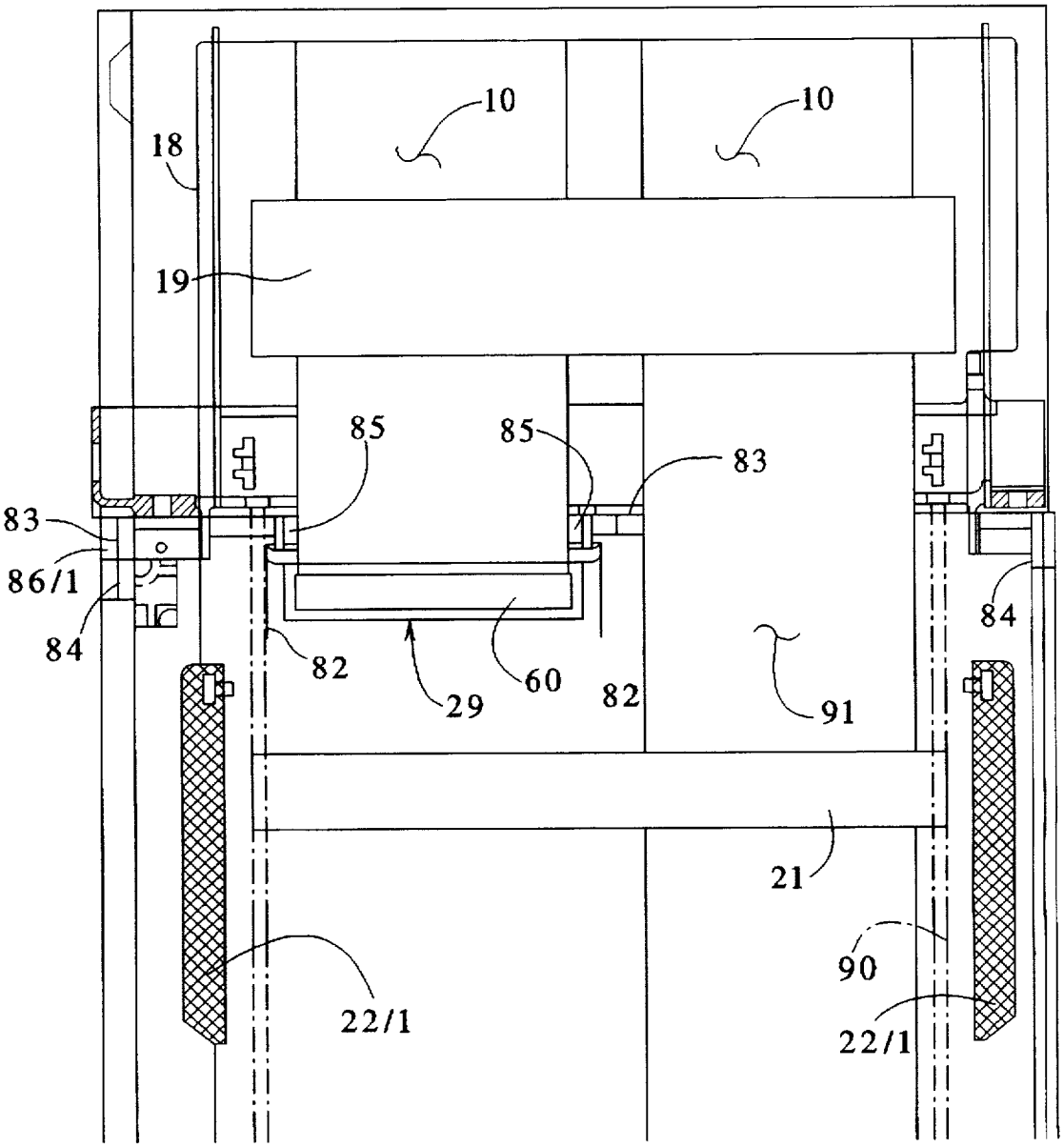
FIG. 13 is a schematic illustration of the return means to the turn-over means from the front.
Figure 14:
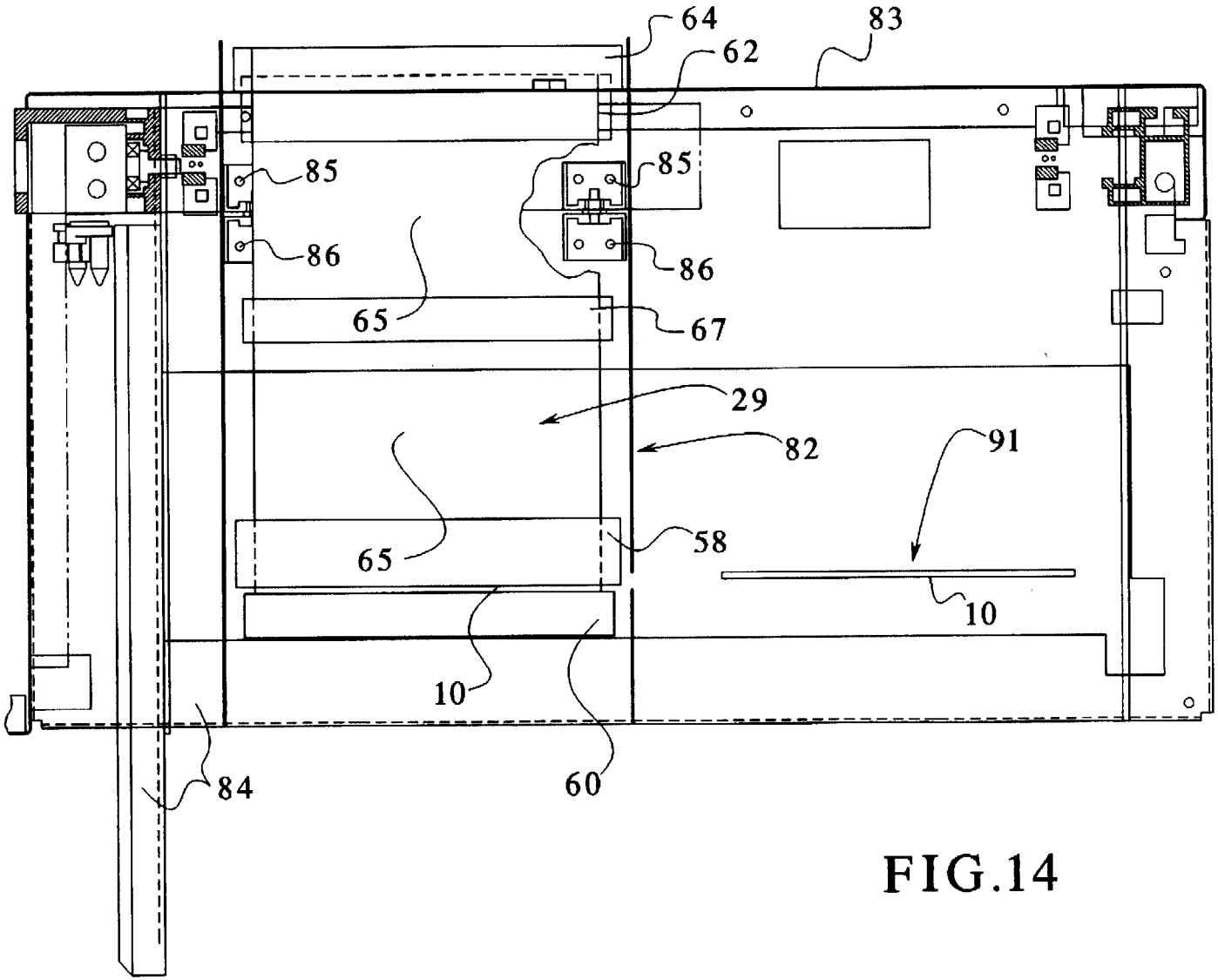
FIG. 14 is a schematic illustration of the return means to the turn-over means from above.

The delivery means is fashioned as independent structural unit in the form of an interchangeable return module. To this end, the traction rollers 57, 66 and 61 together with the appertaining connecting channel 65 are secured between carriers 82 of a module housing 83. The module housing 83 is in turn engaged via corresponding guide elements in telescoping rails 84 that are secured in an acceptance region for the module under the fixing station 18 (FIG. 13). Via these rails 84, the return module can be pulled from the acceptance region and thus be replaced or, respectively, removed. A centering means in order to center the return module in working position in its inserted condition is also allocated to the return means (FIG. 14). In the illustrated exemplary embodiment, the centering means is composed of two centering guides 85 secured to the printer frame into which centering pins 86 secured to the module housing engage. The centering devices can be fashioned such that the electrical connections for the central drive motor and other electrical components spacing between two traction roller pairs, for example the traction roller pairs 57 and 66 or, respectively, 66 and 61, should therefore not fall below the minimum fold spacing length of the prefolded recording medium 10 employed. Recording media with a minimum fold spacing of, for example, 152.4 mm are known in continuous stock printers.

A shunt of the output side in the form of a deflection plate 80 pivotably coupled to the lever 59 is also allocated to the traction roller pair 57 of the input side. In the swivelled-out condition of the pressure roller 60 (shown with broken lines), a through channel for the recording medium opens between pressure roller 60 and transport roller 58 that discharges in an output channel 81 to the delivery means 21 for the internal stacker means 22/1.

The pressing power of the pressure rollers 60, 64 and 68 of the traction roller pairs is variable dependent on the position of the cams 71 and 74. The frictional force on the recording medium 10 situated between transport roller and pressure roller thus varies correspondingly.

The delivery means is fashioned as independent structural unit in the form of an interchangeable return module. To this end, the traction rollers 57, 66 and 61 together with the appertaining connecting channel 65 are secured between carriers 82 of a module housing 83. The module housing 83 is in turn engaged via corresponding guide elements in telescoping rails 84 that are secured in an acceptance region for the module under the fixing station 18 (FIG. 13). Via these rails 84, the return module can be pulled from the acceptance region and thus be replaced or, respectively, removed. A centering means in order to center the return module in working position in its inserted condition is also allocated to the return means (FIG. 14). In the illustrated exemplary embodiment, the centering means is composed of two centering guides 85 secured to the printer frame into which centering pins 86 secured to the module housing engage. The centering devices can be fashioned such that the electrical connections for the central drive motor and other electrical components are simultaneously closed by coupling the centering pins to the centering guides. However, separate plug-type connectors 86/1 (FIG. 13) can also be present. This plug can contain a switch via which the correct connection of the centering means and, thus the presence thereof as well are sensed and reported to the device controller DC in the form of electrical signals.

The internal stacker means 22/1 arranged under the acceptance region for the return module comprises a delivery means 21 that is displaceable dependent on the stack height. The delivery means 21 contains a centering funnel 87 as well as a traction roller pair composed of motor-driven transport roller 88 with appertaining pressure roller 89. The delivery means 21, which is integrated in the upper stacker part of the stacker 22/1, can be lifted or lowered via chains 90. With the return module inserted, it is thus possible to position the delivery means 21 with the delivery roller pair in the region of the output channel and, when the printer module is not present, in the recording medium exit region of the fixing station 18.

Function of the Return Means

In order to be able to automatically thread the start of the recording medium through the turn-over station in duplex operation, the start of the recording medium—with the return module inserted—is supplied to the delivery roller pair 57 via the centering funnel 79. The pressure rollers of the delivery roller pair 57 of the input side, of the middle delivery roller pair 66 and of the delivery roller pair 61 of the output side are swivelled in. The delivery roller pair 57 seizes the start of the recording medium and, supported by the middle delivery roller pair 66 and the delivery roller pair 61 of the output side, conveys it into the paper admission channel 30 of the turn-over means 28, where it is seized by the transport elements arranged thereat and is threaded through the turn-over means 28. The frictional force, particularly in the region of the delivery rollers 57 of the input side, is thereby dimensioned such by turning the cam 74 that the recording medium does not tear off in the region of the fixing station. After being threaded through the turn-over means 28, the start of the recording medium is pushed through the transfer printing station and the back side is thereby printed at the same time. Via the paper output channel 29 of the fixing station 18, it then proceeds in an output channel 91 arranged next to the return channel 29, through the return module, and into the region of the delivery means 21 of the internal stacking means and is grasped by the after. During print operation, the pressure rollers 64 and 68 of the delivery rollers of the middle delivery roller pair 66 and of the delivery roller pair 61 of the output side are then swivelled out, so that only the drive force of the delivery roller pair 57 of the input side takes effect. This is dimensioned such by positioning the cam 74 that it does not react on the paper traction force in the fixing station 18 and negatively influence the paper running therein. In particularly, the traction force dare not be so high that, upon passage of the recording medium through fixing and pressure drum, slippage arises in the fixing station that smears the print format. The transport rollers are constantly driven via the central drive 78 independently of the swivelled condition of the pressure rollers in the traction roller pair. The transport roller 58 of the traction roller pair 57 of the input side engages at the side of the band-shaped recording medium that is free of print format.

Given a print stop in printing operation, the recording medium must be stopped page-suited by the paper transport and must in turn be started page-suited given a print restart. Since a deceleration distance is required at every stop of the paper web and an acceleration distance is required given every start of the paper web, the recording medium must be retracted in front of the transfer printing location after every stop event to such an extent that it can be accelerated and synchronized for the transfer printing given a restart. This back-transport after a stop of the paper web is supported by the return unit with respect to the front side web and by the delivery roller pair of the delivery means 21 with respect to the back side web so that this pull-back of the paper can be implemented given a relaxed paper web insofar as possible. An overload of the paper transport perforations or, respectively, too great a widening of the transport perforations, which leads to positioning errors in the print format after the restart, would result without this pull-back relief. The pull-back roller forces are designed such for the printing operation that the paper web is assured to be reliably transported out of the fixing station. Further, the traction roller forces dare not be so high that they act through the fixing gap between pressure and fixing drum and thus disadvantageously deteriorate the paper running in the fixing station. Given a back-transport after a paper stop, the traction roller pair 88, 89 of the height-displaceable delivery means 21 pulls the printed recording medium 10 load-free from the stacker unit 22/1 or from an after-processing loop 22/2. The traction roller pairs of the return means (front side web), however, must pull the recording medium through the return channel 29 and the turn-over means 28. The pull-back resistance is relatively high due to the deflections. So that no slippage of the recording medium occurs in the region of the delivery roller pair 57 of the input side, the pressing power of the pressure roller 60 against the transport roller 58 is increased with the motor operator 73 via the cam 74, and, thus, a corresponding traction force of the traction roller pair 57 is achieved that is so high that the frictional forces of the paper web can be overcome. The rotational sense of the central drive motor 78 is thereby reversed for the paper pull-back. In order to increase the traction force of the paper web during the paper pull-back, it is also possible to swivel the pressure rollers 68 and 64 of the traction roller pairs 66 and 61 in with the motor operator 70 and to thus support the pull-back. When the paper transport is run up again after a printer stop and during printing operation, the traction rollers 66 and 61 are opened and the pressing power is reduced in the region of the traction roller pair 57 of the input side.

As already initially described, the printer device also makes it possible to print a broad recording medium 10/3 on only one side during simplex mode or, on the other hand, to simultaneously print two narrow recording media 10/1, 10/2 arranged next to one another in simplex mode. When the full stack height of the internal stacker means 22/1 is to be maintained for this simplex mode, it is necessary to remove the return module from the printer device. In this case, the delivery means 21 can be moved to a point directly under the paper exit region of the fixing station 18. So that the return module need not be removed given a lower stack height, however, the shunt with the swivellable deflection plate 80 is arranged in the region of the traction roller pair 57 of the input side. By swivelling the deflection plate 80 out, a through channel with appertaining output channel 81 opens through the return module and the recording medium or media 10/1, 10/2, 10/3 can be supplied to the delivery means 21 through the return module. Meaningfully, the movement of the deflection plate 80 is coupled to the movement of the pressure roller 60. The execution of the movement can be manually implemented by the printer user; it can also ensue automatically, motor-driven via the motor operator 73. The return module thus need not be removed every time when switching from duplex mode to simplex mode or vice versa.

An embodiment of the conveyor means arranged at the input side at the connecting channel 65 shown in FIGS. 15 through 20 contains a mount 101 for the acceptance of, for example, three pressure rollers 60/1, 60/2, 60/3 arranged next to one another, this mount 101 being pivotably seated in a module housing 83 via bearing neck 100 (FIG. 18). The pressure rollers 60/1, 60/2, 60/3 forming a pressure drum unit are thereby rotatably arranged in recesses of a spring steel sheet 102 that is secured on the mount 101 via screws at its side facing away from the pressure rollers. A shunt element 80 in the form of a deflection plate 103 is also rotatably seated on the bearing neck 100 of the mount 101, this shunt element 80 being supported in a depression of the mount 101 with predetermined prestress via a compression spring 104. The employment of a torsion spring in the region of the bearing neck 100 is also possible instead of such a spring.

Pegs 105 arranged at both sides on the mount 101 under the bearing neck 100 pass through housing openings and serve for the acceptance of a respective excursion element 106 in the form of a ball-borne roller element. Under the influence of restoring springs 107 arranged in the region of the bearing neck 100 of the mount 101, the excursion elements 106 are pressed against the curve profile of eccentric disks 109 in the form of cam plates secured on a rotational axis 108. Catch depressions 110/1, 110/2, 110/3 allocated to the respective excursion positions of the mount 101 are arranged on the eccentric disks 109 between the curve profiles.

The pressure roller unit 101 is actuated in conjunction with the shunt 103 by swivelling the rotational axis 108 via an actuator. In this swivel event from a swivelled-out position shown in FIG. 15 with opened through channel 81 into a swivelled-in position shown in FIG. 16 in which the pressure rollers 60/1, 60/2, 60/3 press against the transport roller 58, the shunt element 103 places its front edge against a detent 111 in the form of a housing part. As a result thereof, a deflection channel 112 with a predetermined channel width serving for threading the recording medium 10 into the connecting channel 65 is formed between shunt element 103 and transport roller 58. The pressing power of the pressure roller 60/1, 60/2, 60/3 against the transport roller 58 and, thus, the frictional force on the recording medium 10 can be set by a corresponding positioning of the cam plate 109. Different settings of the pressing power can be necessary dependent on the material properties of the recording medium 10 and the operating mode of the printer.

Figure 19:
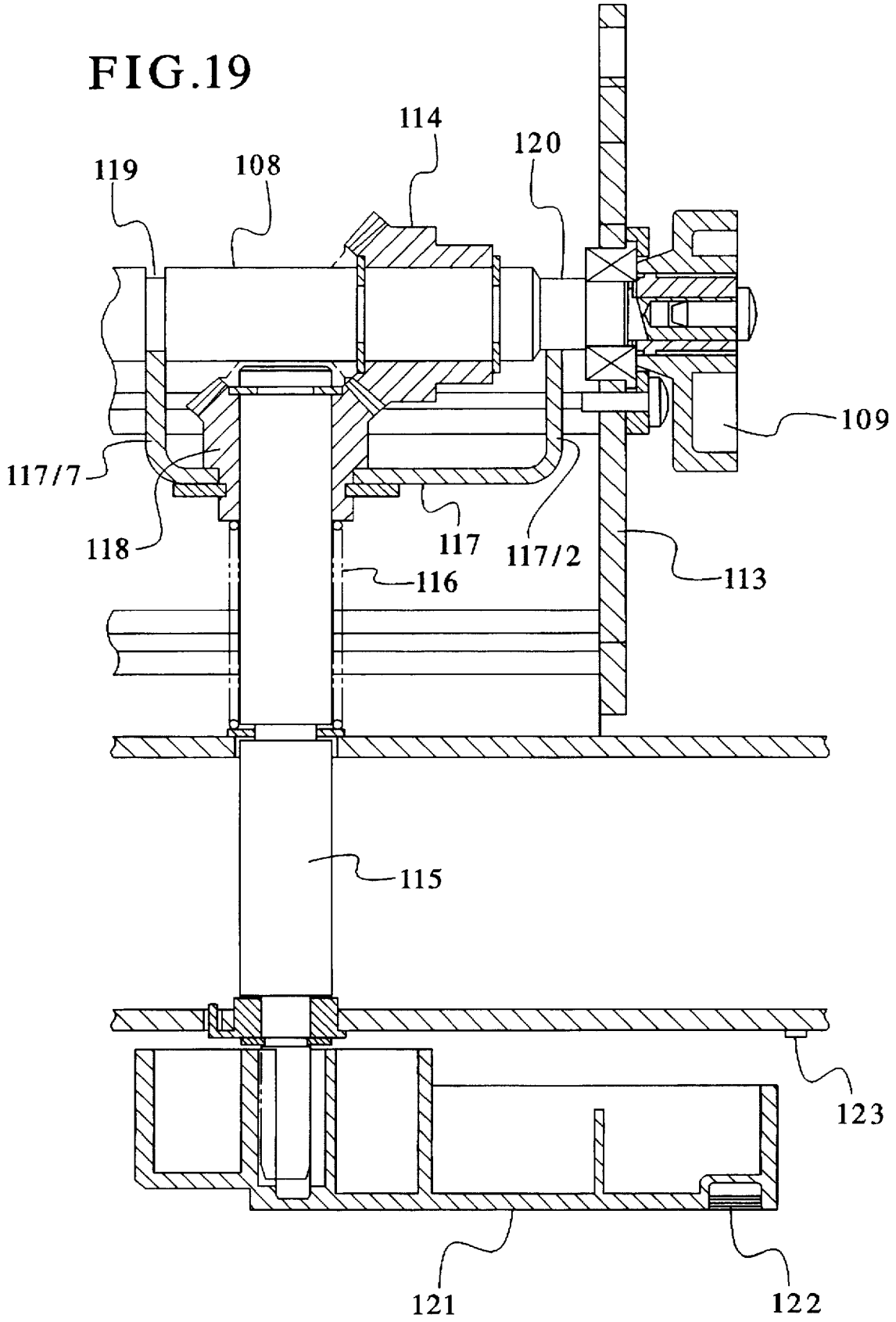
FIG. 19 is a schematic sectional view of an actuation drive arranged in the conveyor means in its coupled-in, fixed condition.
Figure 20:
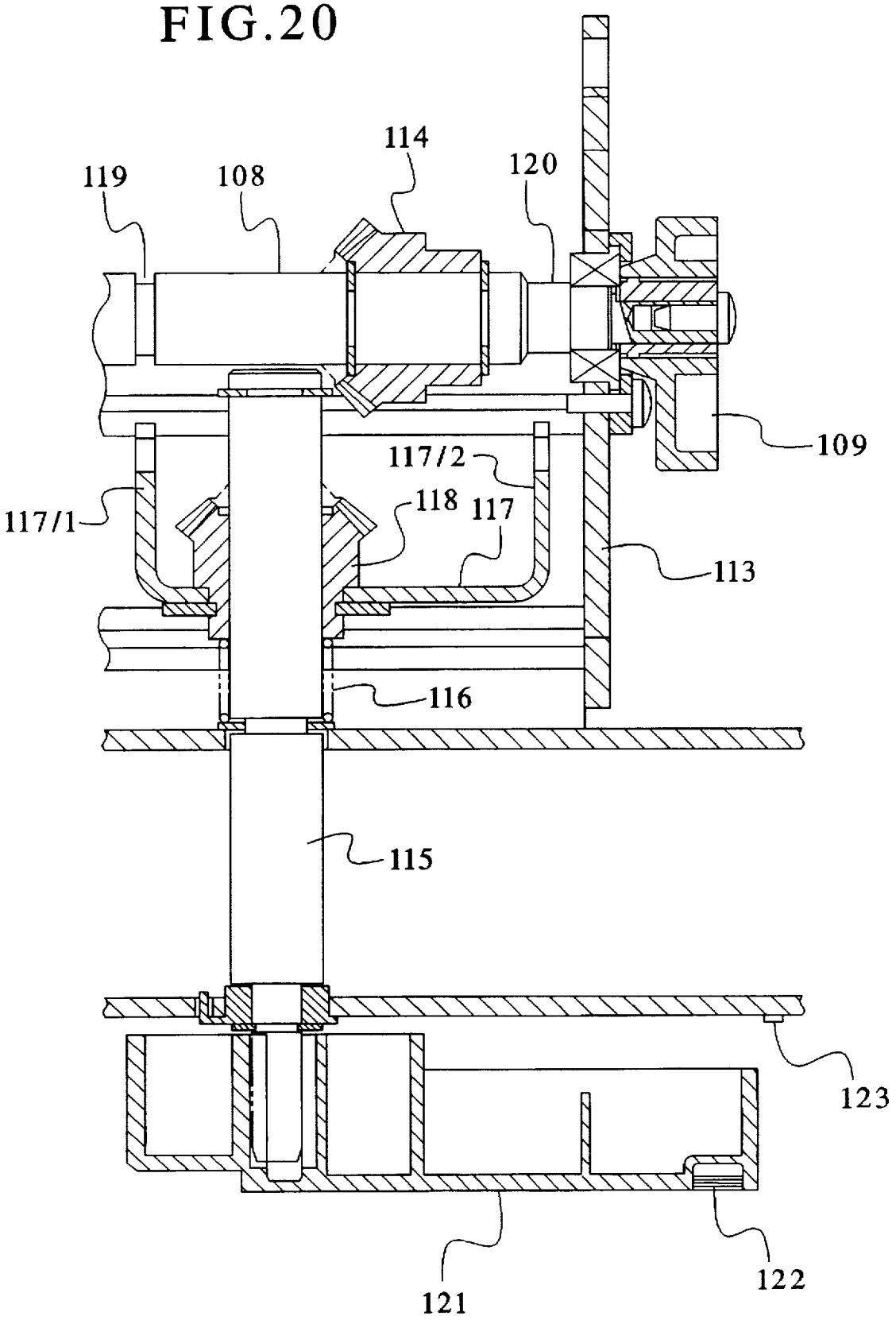
FIG. 20 is a schematic sectional view of the actuation drive in its decoupled adjustment condition.

The actuator shown in FIGS. 19 and 20 serves the purpose of swivelling the pressure drum unit with the pressure rollers 60/1, 60/2, 60/3 situated thereon together with appertaining shunt element 103 into different operating positions. By turning the eccentric disk 109 with the assistance of the rotational axis 108, the excursion position is varied according to the course of the curve. The notchings (catch depressions) 110/1, 110/2 and 110/3 of the eccentric disk 109 on the curve surface define the different operating positions. Dependent on the specification or the operating mode of the printer device, it can be necessary to define the the starting operating position by allocation of a corresponding notch 110/1, 110/2, 110/3 and to allocate a defined position of an operating lever 121 thereto. For this reason, it is favorable to fashion the actuator adjustable.

The actuator contains the profiled rotational axis 108 that is seated between housing elements 113 and on which the eccentric disk 109 and a conical gear wheel 114 are arranged with positive fit. A setting shaft 115 on which a further conical gear wheel 118 is located that is torsionally secured, for example via a channel, and that is axially displaceable via a positioning element 117 and, thus can be brought into and out of engagement with the conical gear wheel 114 is arranged at a right angle relative to the rotational axis 108. The positioning element 117 is composed of a U-shaped sheet metal piece that rotationally accepts the conical gear wheel 118 and that has lateral shoulders 117/1, 117/2 serving as support elements that are supported positionally secured on the rotational axis 108 in the meshed condition of the conical gear wheels 114, 118. To this end, the rotational axis 118 comprises a cylindrical channel 119 that is arranged in an exactly defined spacing from the conical gearwheel 114 and also comprises a cylindrical seating region 120. Corresponding recesses that interact with the cylindrical channel 119 and the cylindrical seating region 120 are fashioned at the end of the supporting elements 117/1, 117/2. As a result thereof, the conical gear wheels 114, 118 are positioned both in longitudinal as well as in transverse direction, whereby the spring 116 presses the positioning element 117 into the channel 119 and against the seating region 120.

The setting shaft 115 carries the operating lever 121 at its end secured with positive fit. It is seated in the housing in this region.

The setting shaft 115 and the rotational axis 108 of the eccentric disk can be uncoupled in that the positioning element 117 with the conical gear wheel 118 is manually axially displaced in the direction of the operating lever bearing opposite the action of the spring 116 (FIG. 20).

Figure 15:
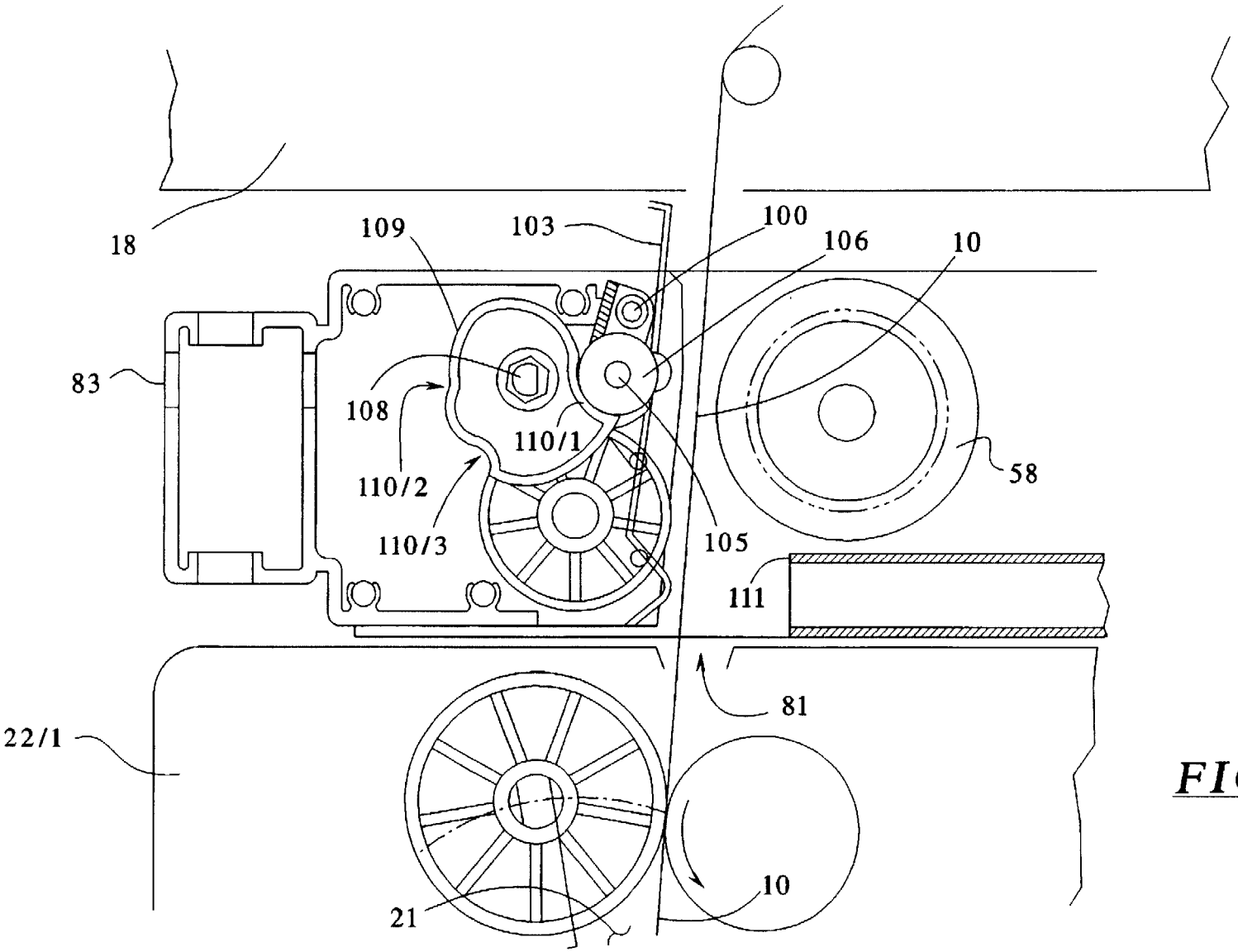
FIG. 15 is a schematic illustration of a conveyor means allocated to the return means at the input side in its swivelled-out position.
Figure 16:
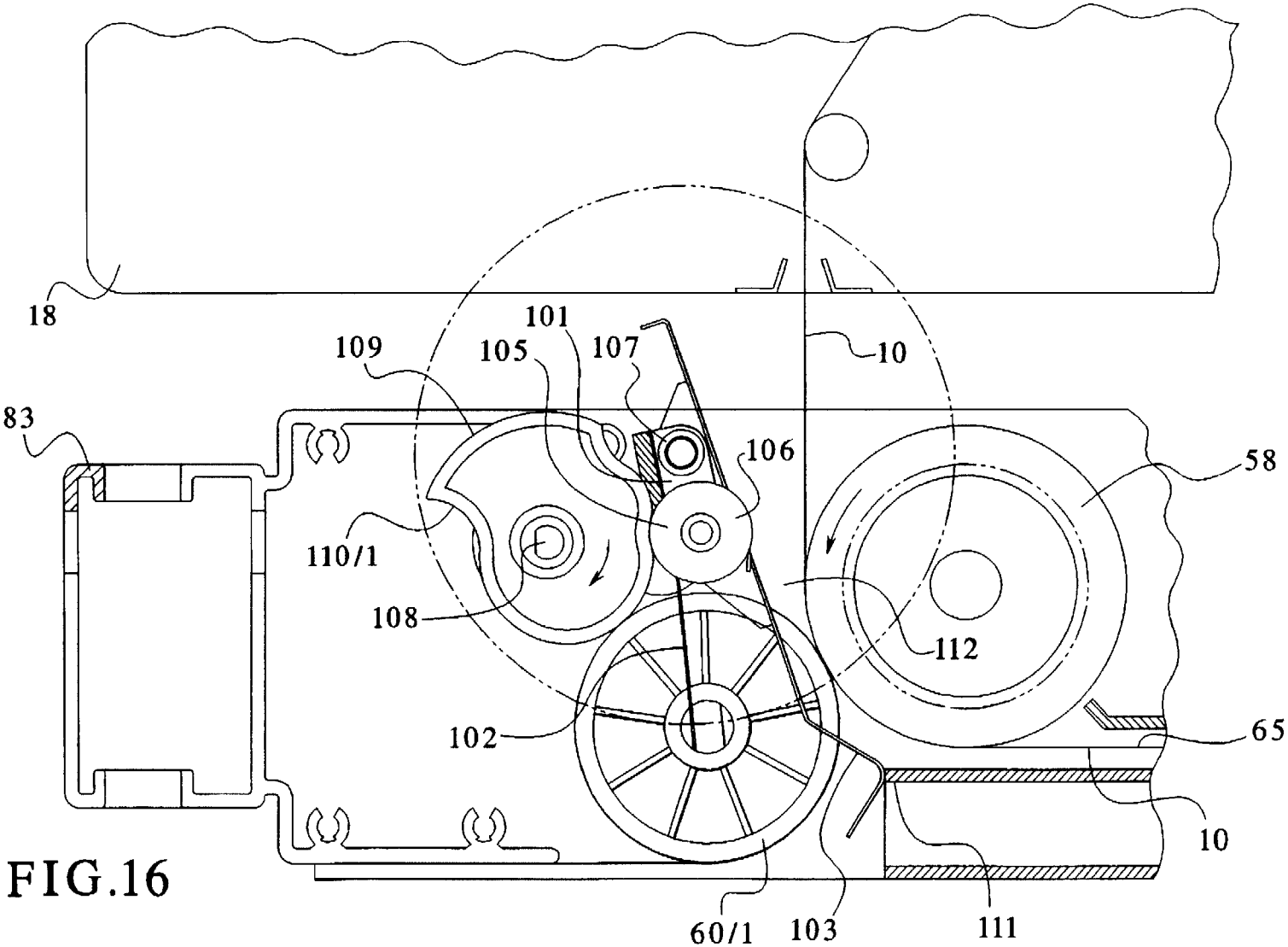
FIG. 16 is a schematic illustration of a conveyor means allocated to the return means at the input side in its swivelled-in position.

The following axle settings or, respectively, actions must thereby be carried out for the ultimate use adjustment of the unit, whereby it is assumed that the setting is to be to the swivelled-out position (allocation of the catch position 110/1 to the excursion element 106) shown in FIG. 15.

First, the actuation lever 121 with its marking 122 applied thereon is turned into zero position. The marking 122 must thereby point exactly at switch position marking 123 on the housing. After this, the setting shaft 115 and the rotational axis 108 of the eccentric disk are manually uncoupled by pushing the positioning element 117 back (FIG. 20). Subsequently, the rotational axis 108 of the eccentric disk is turned such that the roller element 106 engages into the corresponding notching 110/1, and the uncoupling is then in turn cancelled.

An arbitrary axial angular position of the setting shaft 115 relative to the rotational axis 108 can be set in this way and, for example, the range of pressing power can thus also be varied.

The turn-over means 28 arranged in the internal supply region 23/1 limits the bearing region available for the acceptance of a supply stack, namely in view of the employable format height (spacing between folds of the prefolded continuous stock). The acceptance surface 23 of the internal supply region is thereby designed such that it can accept a supply stack with the largest possible print width and large format height when the turn-over means 28 is removed. When, thus, the printer device is operated in simplex mode with a wide recording medium 10/3 with large format height, for example 355.6 mm, it is necessary to remove the turn-over means 28 from the supply region. The turn-over means 28 can remain in the supply region in simplex mode with a narrow recording medium or with two narrow recording media conducted parallel if a very large format height is not to be printed at the same time. Given format heights of more than about 304.8 mm, the turn-over means must be removed.

As explained in conjunction with the structure of the delivery means and the turn-over means, their electrical coupling means (FIGS. 4, 13) comprise switches 45/1 and 86/1 via which the correct connection or, respectively, the presence of these units is sensed and reported to the device controller DC in the form of electrical signals. Other sensing means, for example light barriers or the like, can also be provided instead of switches. It is also possible to sense the presence of these units via the electrical coupling elements themselves by sensing the connections via sampling signals proceeding from the device controller DC.

The electronic device controller DC of the printer automatically recognizes the presence or, respectively, the absence of the units delivery means (duplex return) and turn-over unit by evaluating the sensor signals via a monitoring means that, for example, can be fashioned in the form of an OR operation. An automatic determination can thus be made via the device controller DC of the printer device that, with the duplex return removed, the maximum processable paper stack height in the output compartment of the printer can again be increased by the structural height of the duplex return and, with the turn-over unit removed, the maximally processable paper format height in the input compartment of the printer can again be increased by the structural width of the turn-over unit. This can be displayed in a control field display 92 at the printer module (FIG. 10) in the form of an alphanumerical message.

Whenever one of the two units, duplex return or turn-over unit, is removed from the printer, the electronic device controller DC automatically switches all device functions to simplex mode, and the electronic device controller DC fully automatically outputs error message via the control field display 92 at the printer module when the user of the printer attempts to access duplex functions.

The described exemplary embodiment of the multifunctional printer device contains a turn-over module with automatic threading means. However, it is also possible to employ a turn-over module having a structure conforming to the schematic illustrations of FIGS. 1 through 3 wherein the recording medium is manually threaded as warranted. Given employment of a recording medium with properties (paper weight, structure, etc.) that do not allow an automatic threading, the turn-over module can be replaced for this operating mode. This is also true of the delivery module.

The term "electrophotographic printer device" is also intended to cover printer or copier devices that employ magnetographic or electrostatic recording processes.

Although other modifications and changes may be suggested by those skilled in the art, it is the intention of the inventors to embody within the patent warranted hereon all changes and modifications as reasonably and properly come within the scope of their contribution to the art.

We claim:

1. A printer for optional one-sided or double-sided printing of a band-shaped recording medium, comprising:

an intermediate carrier with appertaining units that generate toner images, a transfer printing station transferring the toner images onto the recording medium and a fixing station, each having a usable width of a least twice a band width of a recording medium to be printed double-sided;

a return channel with conveyor means in order, after printing of a front side of the recording medium, to conduct the recording medium from the fixing station via a connecting channel to a turn-over means in which it is turned over and resupplied to the transfer printing station for printing a back side of the recording medium, wherein the conveyor means comprise:

a controllable, motor-driven conveyor means that is arranged at an input side to the connecting channel that has at least one transport roller and a pressure drum unit swivellable against and away from the transport roller comprising at least one pressure roller with an allocated shunt that, in the opened swivelled condition, forms a through channel for a recording medium to be printed on only one side and, in the swivelled-in condition, conducts the recording medium to be printed double-sided around the transport roller into the connecting channel to the turn-over means.

2. A printer according to claim 1, further comprising:

a controllable, motor-driven conveyor means arranged at the output side relative to the connecting channel having at least one transport roller and at least one pressure roller that are seated swivellable relative to one another, whereby a channel width of the connecting channel is dimensioned such that a buckling of the recording medium is largely prevented.

3. A printer according to claim 1, further comprising:

a connecting channel whose length is shorter than a fold spacing of a prefolded recording medium to be printed.

4. A printer according to claim 1, further comprising:

an additional, motor-driven, controllable conveyor arranged in the connecting channel with at least one transport roller and at least one pressure roller that are seated swivellable relative to one another.

5. A printer according to claim 1, further comprising;

a means allocated at least to the input-side conveyor means of the connecting channel for setting frictional force on the recording medium.

6. A printer according to claim 5, further comprising;

a cam engaging at said at least one pressure roller for varying pressing power.

7. A printer according to claim 1, further comprising:

a central drive for the conveyor devices of the connecting channel.

8. A printer according to claim 1, further comprising:

a conveyor means of the input side that comprises a mount that can be swivelled via an excursion means and at least one pressure roller resiliently seated thereon whose range of swivel the transport roller is situated, whereby the pressure roller presses the recording medium against the transport roller with a pressing power dependent on the excursion position of the mount, as well as a shunt element allocated to the mount.

9. A printer according to claim 8, further comprising:

a pivotably seated shunt element resiliently seated on the mount in whose range of swivel a detent is arranged such that the shunt element places itself against the transport roller corresponding to a predetermined channel width when the pressure rollers are swivelled in.

10. A printer according to claim 8, further comprising:

a shunt element that comprises a glide surface extending over a width of the transport roller and that contains openings for acceptance of the pressure rollers.

11. A printer according to claim 8, further comprising:

a leaf spring element that accepts the pressure rollers and is secured on the mount.

12. A printer according to claim 8, further comprising:

an excursion means that contains a cam plate comprising a curve profile with catch depressions on whose curve surface an excursion element connected to the mount is supported.

13. A printer according to claim 12, whereby the excursion element is a ball-borne roller element.

14. A printer according to claim 8, further comprising:

a mechanically uncouplable actuator with a rotational axis that is of a cooperating shape to accept a conical gear wheel and drive the excursion means, a setting shaft arranged at an angle relative to the rotational axis on which a further conical gear wheel that is axially displaceable via a positioning element opposite a spring power and, thus, can be engaged with and disengaged from the conical gear wheel is located torsionally secured, whereby the positioning element accepts the further conical gear wheel rotationally movable and, in the meshed condition of the conical gear wheels, is supported positionally secured on the rotational axis via supporting elements.

15. A printer according to claim 14, further comprising:

an actuation lever connected to the setting shaft with form fit.

16. A printer according to claim 14, wherein at least one of the supporting elements of the positioning element engages into a positioning channel that is arranged on the rotational axis in a defined position relative to the conical gear wheel.

17. A printer according to claim 1, further comprising:

a turn-over means that comprises an automatic threading means for the recording medium.

18. A printer according to claim 17, further comprising:

a turn-over means with a paper admission channel and a paper discharge channel that are arranged next to one another;

a first oblique deflection means that laterally deflects the recording medium supplied via the paper admission channel;

a first reversing means following the first oblique deflection means in paper conveying direction for returning the recording medium behind the paper channels into the region of a second reversing means that is arranged about parallel to the first reversing means and reverses the recording medium again;

a second oblique deflection means that follows the second reversing means and deflects the recording medium into the paper discharge channel; and a threading means for the recording medium comprising a motor-driven gripper element guided around the reversing devices that comprises gripper means for the start of the recording medium, whereby, for being threaded into the turn-over means, the start of the recording medium is grasped in the region of the first oblique deflection means and is transported into the region of the paper discharge channel via the reversing means and the second oblique deflection means.

19. A printer according to claim 1, further comprising:

a stacker means for the recording medium that comprises a delivery means height-displaceable at least into the exit region of the through channel of the conveyor means.

* * * * *